US011800916B2

(12) United States Patent
Khuu et al.

(10) Patent No.: US 11,800,916 B2
(45) Date of Patent: Oct. 31, 2023

(54) HAIR TIE HOLDER DEVICE

(71) Applicants: Britney Khuu, Reno, NV (US); Sion Gutentag, Reno, NV (US)

(72) Inventors: Britney Khuu, Reno, NV (US); Sion Gutentag, Reno, NV (US)

(73) Assignee: Hair Tie Hub LLC, Las Vegas, NV (US)

( * ) Notice: Subject to any disclaimer, the term of this patent is extended or adjusted under 35 U.S.C. 154(b) by 912 days.

(21) Appl. No.: 16/697,045

(22) Filed: Nov. 26, 2019

(65) Prior Publication Data

US 2020/0163429 A1 May 28, 2020

Related U.S. Application Data

(60) Provisional application No. 62/771,539, filed on Nov. 26, 2018.

(51) Int. Cl.
*A45D 8/00* (2006.01)

(52) U.S. Cl.
CPC ..... *A45D 8/002* (2021.01)

(58) Field of Classification Search
CPC . A45D 8/00; A45D 8/002; A45D 8/14; A45D 8/16; A45D 8/20; A45D 8/22; A45D 8/34; A45D 8/36; A45D 8/185; A45D 24/10; A45D 24/12; A45D 24/38; A45D 44/04; A45D 2/24; A43C 7/04; A43C 7/005; B65D 85/02; B65D 85/04; B65D 11/05; B65D 11/1886; B65D 11/188; D05B 91/14; D05B 91/16
See application file for complete search history.

(56) References Cited

U.S. PATENT DOCUMENTS 3,869,044 A * 3/1975 Olsson ..... A61B 17/06138 206/227
5,022,127 A * 6/1991 Ang ..... A43C 7/005 24/712.2
5,117,988 A * 6/1992 Daniels ..... A47G 25/06 248/205.2
6,802,471 B1 * 10/2004 Gambrell ..... B65H 75/06 242/402
2004/0007640 A1 * 1/2004 West ..... B65H 75/06 242/402
2006/0248693 A1 * 11/2006 Walker ..... A43C 7/005 24/712.2

(Continued)

FOREIGN PATENT DOCUMENTS

WO WO-2011149361 A2 * 12/2011 ..... B65H 75/4473

*Primary Examiner* — Cris L. Rodriguez
*Assistant Examiner* — Karim Asqiriba
(74) *Attorney, Agent, or Firm* — Kilpatrick Townsend & Stockton LLP

(57) ABSTRACT

Devices for holding one or more flexible or elastic loops or bands, in particular hair ties, are disclosed herein. Such devices can include first and second portions having one or more protruding features around which one or more loops or bands can be secured in place. The first and second portions can be movably attached so as to move between an open position for placement of the one or more loops thereon, and a closed position to secure the one or more loops drawn taut or in a folded configuration. The device can be secured in the closed position with a fastener to maintain the one or more loops stored within for portable storage.

9 Claims, 28 Drawing Sheets

(56) References Cited

U.S. PATENT DOCUMENTS

| | | | | |
|---|---|---|---|---|
| 2011/0083993 | A1* | 4/2011 | Mesika | A45C 11/24 206/784 |
| 2012/0085129 | A1* | 4/2012 | Kienzle | A44C 5/2042 63/15 |

* cited by examiner

HAIR TIE HOLDER DEVICE

CROSS-REFERENCES TO RELATED APPLICATIONS

This application claims the benefit of priority of U.S. Provisional Application No. 62/771,539 filed on Nov. 26, 2019, the entire contents of which are incorporated herein by reference in their entirety.

FIELD OF THE INVENTION

The present invention pertains to a device for holding one or more flexible or elastic ties, loops or bands, in particular hair ties or loops.

BACKGROUND

Flexible or elastic hair ties and bands are easily misplaced and lost and often are not readily available away from home. Currently, there are hair tie holding bracelets on the market, however, such bracelets typically hold only one band at a time and the band can easily slip off or get dirty. Hair ties are also commonly carried on the wrists, kept in purses, stringed on various other gadgets, or even tied onto backpacks. However, these methods are often messy and still lead to misplaced, lost or dirty hair ties. Other hair tie holders exist but only address at home storage. Beyond the hair tie holding bracelets, there is currently no practical solution to storing hair ties on the go. Thus, there exists a need for a hair tile holding device that allows for improved storage of multiple hair ties in a manner that is portable, compact and easy to use.

BRIEF SUMMARY

In one aspect, the invention pertains to a holder device for storing multiple flexible bands that includes first and second portions, each portion having one or more protrusions or pegs, arranged for placement of one or more flexible loops thereon. The first and second portions are movable between an open position to receive the one or more loops and a closed position in which the one or more loops are drawn taut and folded in a more compact configuration.

In some embodiments, the device includes a first arm having a first end and a second end, the first arm having a first protruding peg and a second arm having a first end and a second end, the second arm having a second protruding peg. A hinged portion couples the first arm and the second arm at the first ends of each and is configured to move or fold the first and second arms between an open position and closed position. In the open position, the first and second pegs are accessible from one side of the device for placement of one or more loops thereon. In the closed position, the first and second pegs face in opposite directions to draw the one or more loops taut and fold the loops, at least partly. Each of the first and second pegs can include an angled support member inwardly angled toward the hinged portion. In some embodiments, the device includes a latch to maintain the first and second arms in the closed position. The latch is releasable to allow the user to open the device and remove one or more loops. In some embodiments, the device includes a lateral guidewall on each of the first and second arms on a same side as the first and second pegs, the guidewall adapted to retain the one or more loops in position during folding of the first and second arms from the open position to the closed position. The device can further include a portability feature, such as a hole or loop for attaching the device to a keychain. Typically, the device is formed of a substantially rigid or semi-rigid material that is sufficiently rigid to hold the one or more loops drawn taut, at least partly. The device can be made of plastic, metal, or any suitable material or combination of materials. It is appreciated that the device can be made in any color or combination of colors and that the color can be imparted into the material from which the device is made or can be added by a coating, label, shrink wrap or any suitable means. It is further appreciated that the device can include logos or text features visible thereon, for example, by molding or engraving the text or logo in any part of the device or by a label, shrink wrap, shrink band or any suitable means applied on a surface of the device.

In some embodiments, the device includes a first portion having one or more protrusions extending therefrom and a second portion having one or more protrusions extending therefrom. The device includes at least a first and second protrusion around which the one or more loops can be placed and drawn taut. The first and second portions are movably attached so as to move between a closed position and an open position. The device is configured such that in the open position, the one or more protrusions are accessible by the user to receive the one or more flexible loops placed along a path extending around the protrusions, and in the closed position, at least one protrusion of the second portion moves so as draw the one or more flexible loops taut, at least partly, and fold the flexible loop into a more compact configuration. Typically, the first and second portions are attached by a hinge portion along an intermediate portion. The hinge portion can include one or more hinge pins disposed within the first and second portions, for example parallel pins in a floating hinge configuration. In some embodiments, the hinge portion is a flush hinge configuration so that the device lies substantially flat in the open position to facilitate placement of the one or more loops on the device. In some embodiments, the device includes one or more guides along the intermediate portion on opposite sides of the path to retain the one or more loops along the path when the first and second portions are moved from the open position to the closed position. It is appreciated that any of the embodiments described herein could use any suitable type of hinge, including but not limited to a floating hinge, a flush hinge, a simple pivot and a living hinge. Such hinges can be formed of metal, plastic, ceramic, or any suitable material.

In some embodiments, the one or more protrusions are defined as pegs such that the first portion includes at least a first peg and the second portion includes at least a second peg, each peg extending in a transverse direction from a plane along which the respective portion extends. Typically, the first and second portions are configured to fold at a middle hinge portion such that in the open position, the first peg and second pegs are disposed on one side of the device; and in the closed position, the first and second pegs are disposed on opposite sides of the device. In some embodiments, the first and second pegs are angled in opposite directions when the first and second portions are in the open position. Each peg can further include a retainer portion to maintain the one or more loops. The retainer portion can include an enlarged or angled portion at or near the distal portion of the respective peg. In some embodiments, the device includes a fastener or closure means to hold the first and second portions in the closed position with the one or more flexible loops secured by the one or more protrusions. The fastener can be defined as a latch, a snap-fit feature, a friction fit feature, a magnet or any suitable means.

In some embodiments, the device includes a fastener or closure means to hold the first and second portions in the closed position with the one or more flexible loops secured by the one or more protrusions. The fastener can be defined as a latch, a snap-fit feature, a friction fit feature, a magnet or any suitable means.

In some embodiments, the device includes a first and second protrusion or pegs and further includes a third protrusion or peg around which an intermediate portion of the loops engage when the device is folded into the closed position. In some embodiments, the device is defined as a pair of arms that fold against a main body portion having sides shaped to fittingly receive the pair of arms.

In other embodiments, the device includes first and second planar members or plates that are substantially parallel and separated by multiple pegs and that remain parallel when moved between the open and closed positions. The first and second plates can be movably attached by a sliding interface between one or more pegs of the one plate and corresponding tracks defined within the other plate. In some embodiments, the first and second plates are movably attached by a laterally rotating connection between the first and second planar members. In some embodiments, the first planar member includes at least two pegs that are accessible when the device is in the open position and that are covered by the second planar member when in the closed position, the second planar member including a third peg that passes between the at least two pegs when the second planar member is rotated into the closed position.

In another aspect, the device can further include a feature for holding or securing additional hair accessories, such as bobby pins. For example, a hole, slot, or raised portion in a plate, peg, or guide wall that is dimensioned to insertably receive and secure one or more bobby pins or to allow bobby pins to dangle from the device. It is appreciated that this feature could be incorporated into any of the embodiments described herein.

Aspects of the present invention can be further understood by reference to the following figures.

DETAILED DESCRIPTION

The present invention pertains to a device for holding one or more flexible or elastic loops or bands, in particular hair ties or loops for securing a user's hair. In some embodiments, the device is configured and dimensioned to hold multiple hair loops or ties, such as at least three hair ties. Such hair ties or loops typically have a diameter of between 1-10 mm, usually about 3-5 mm, and are about 7.5 cm in length when the loop is drawn taut. It is appreciated, however, that the device could be configured to hold more or fewer hair ties or loops and could be configured to hold various other flexible or elastic loops or bands of differing sizes and types, for example rubber bands or industrial belts.

In one aspect, the tie holder device includes first and second portions (e.g., arms), each having one or more protrusions (e.g. pegs) adapted and arranged to hold one or more loops drawn taut, at least partly, when placed around the protrusions. The first and second portions can be movably attached so as to move between an open position for receiving one or more flexible loops around at least two protrusions and a closed position in which the one or more loops are held taut and folded, at least partly, to store the one or more loops in a more compact configuration. The portions can be movably attached by any suitable means, including but not limited to a hinge (e.g. pivot coupling, flexure point, floating hinge, barrell hinge, butt hinge, living hinge) or a sliding interface. The first and second arm portions are typically defined as elongate members, for example planar members, so that the device lies flat in an open position to facilitate placement of the loops thereon. The device can be formed of any suitable material, typically a material that is substantially rigid or rigid enough to hold the one or more loops drawn taut, at least partly. The device is typically formed of hard plastic, however, it is appreciated that the device can be formed of metal, glass, ceramic or any suitable material. Various concepts of the present invention can be understood further by referring to the example embodiments described below.

Figure 1A:
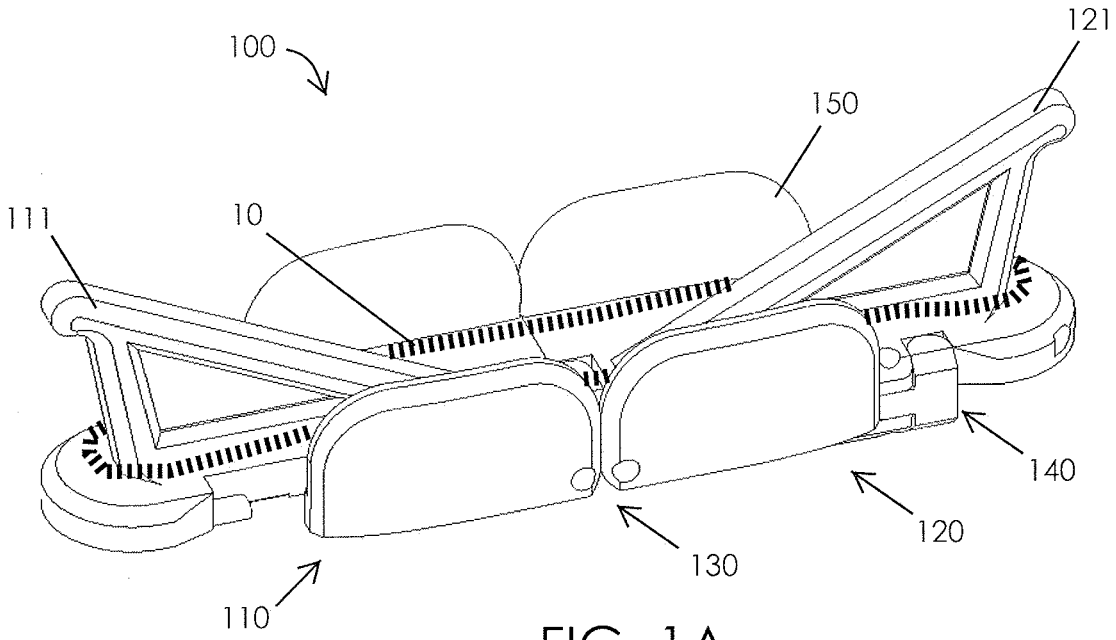
FIG. 1A shows an exemplary hair tie holder in an open configuration with a hair tie placed within, in accordance with some embodiments.
Figure 1B:
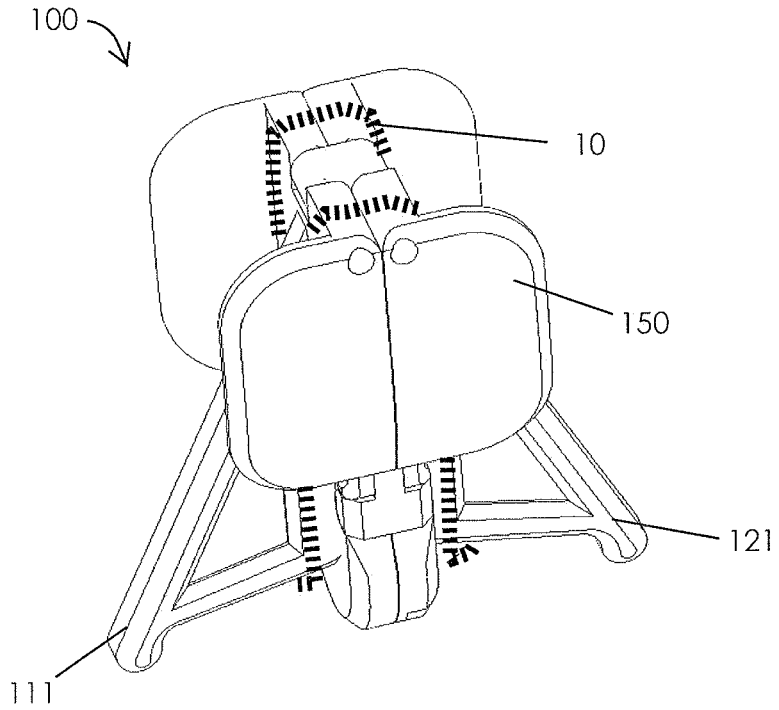
FIG. 1B shows the hair tie holder of FIG. 1A in closed configuration with a hair tie held secured within, in accordance with some embodiments.

FIGS. 1A-1B show an exemplary embodiment of a holder device 100 having first and second portions (e.g. arms 110, 120) joined at a hinged middle portion 130 such that the device can be folded between an open position (see FIG. 1A) to facilitate placement of one or more hair ties 10 thereon and a closed position (see FIG. 1B) to secure and hold the one or more hair ties 10 drawn taut. Each arm 110, 120 includes an upwardly extending protrusion 111, 121 (e.g. peg) near an end portion. In this embodiment, each peg further includes an inwardly angled support member that improves the strength of each peg and facilitates handling of the device. Each arm portion can further include two opposing guidewalls or guides 150 that help retain or hold the hair ties and prevent them from falling off when the device is folded from the open position to the closed position. The device can further include a fastener 140 or any suitable means for releasably securing the device in the closed position.

As can be seen in FIG. 1A, in order to attach a hair tie or loop, it is placed over the two protruding pegs 111, 121 with the device in the open position in which the protruding pegs are easily accessible from one side of the device. The device then folds into the closed position and is latched, as shown in FIG. 1B, holding the hair tie in a more compact configuration for storage. To remove the hair tie or band, the user unlatches the device and opens the device to allow ready removal of one or more loops from the protruding pegs. In some embodiments, the holder device further includes a portability feature, such as a hole or a loop, to attach to keychains, backpacks, or bags to facilitate improved portability of the device. It is appreciated that this feature could be incorporated into any of the embodiments described herein.

Figure 2A:
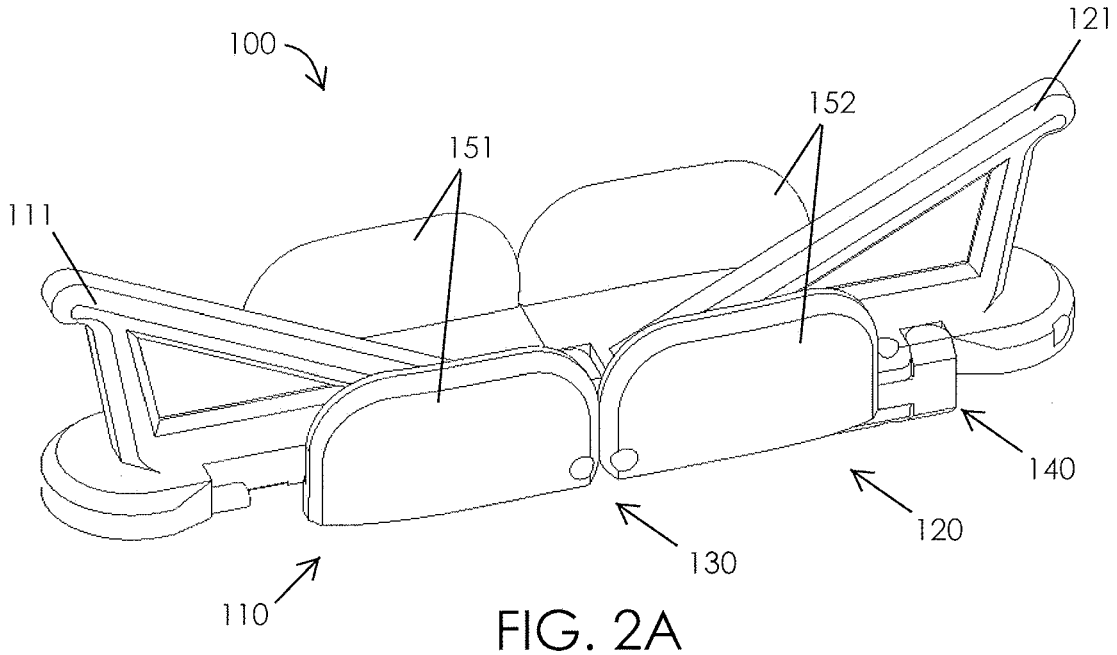
FIGS. 2A-2B show top and bottom perspective views of the hair tie holder of FIG. 1A in an open position, in accordance with some embodiments.
Figure 2B:
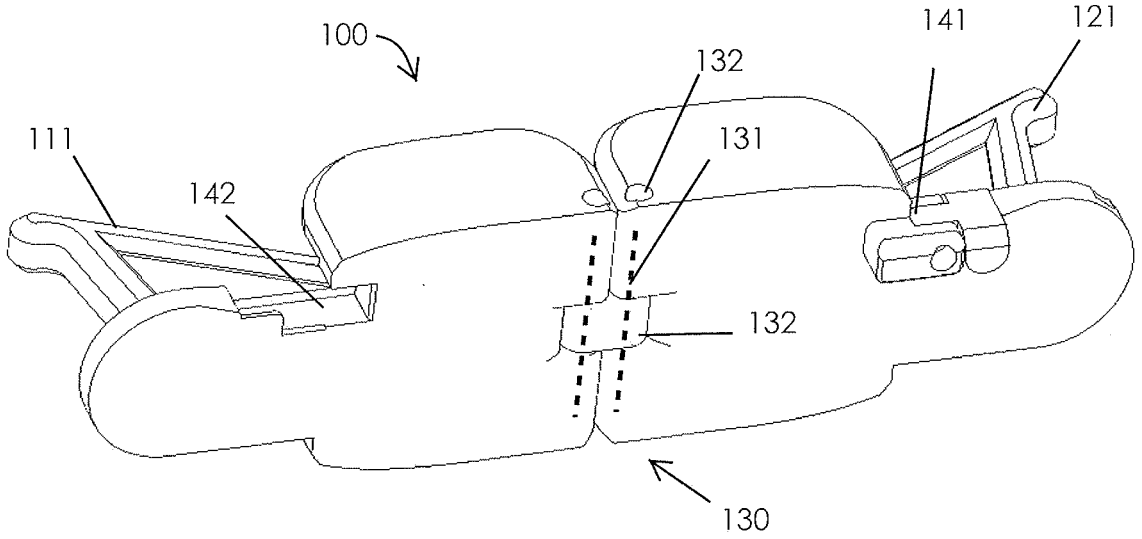
Figure 3A:
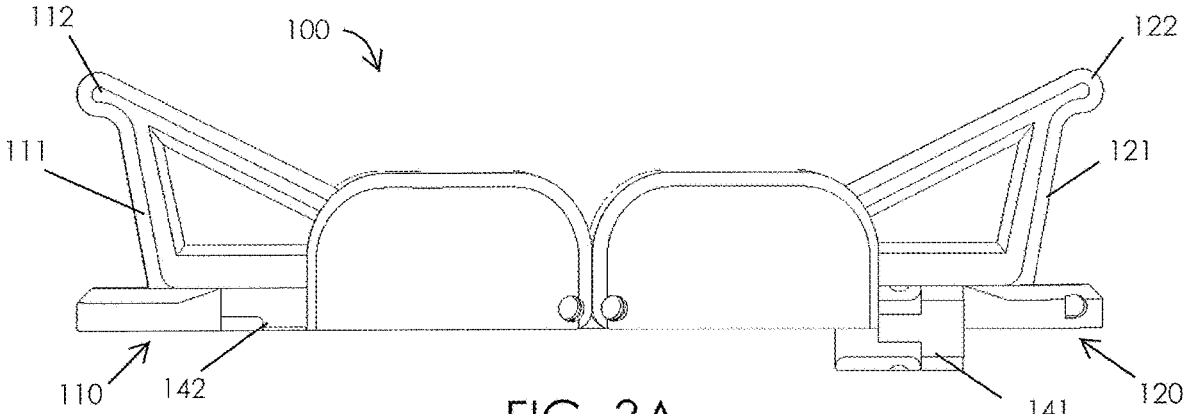
FIGS. 3A-3B show left and right side views of the hair tie holder of FIG. 1A in an open position, in accordance with some embodiments.
Figure 3B:
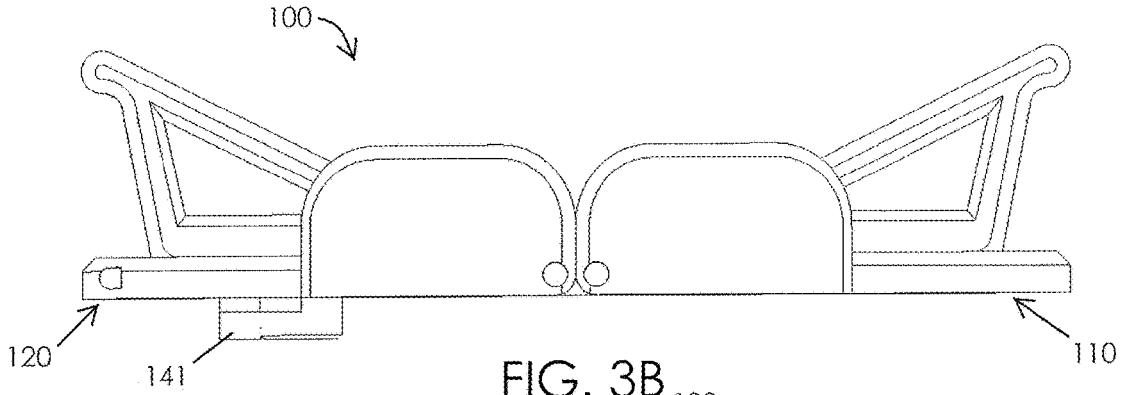

FIGS. 2A-2B show top and bottom perspective views of the hair tie holder of FIG. 1A in an open position. Each of protrusions or pegs 111, 121 further includes a retainer feature or retainer portion defined as an outwardly angled portion 112, 122 to further retain the one or more loops or bands when placed around the pegs, as shown in FIG. 3A. The lateral guidewalls or guides 151, 152 are disposed on opposite sides along the middle portion of each arm to retain the one or more loops or bands in position. The hinged portion 130 utilizes parallel pins 131 that extend through corresponding holes 132 in each arm 110, 120 and are linked by floating hinge body 132 in a flush hinge configuration. This design allows the device to lie substantially flat when in the open position and allows each arm to pivot away from each other to interface in the compact closed position. In some embodiments, the design of the lateral guides engage each other to prevent rotation beyond the open position shown in FIG. 2A such that the full range of movement of the hinge is entirely between the open position and the closed position.

Figure 3C:
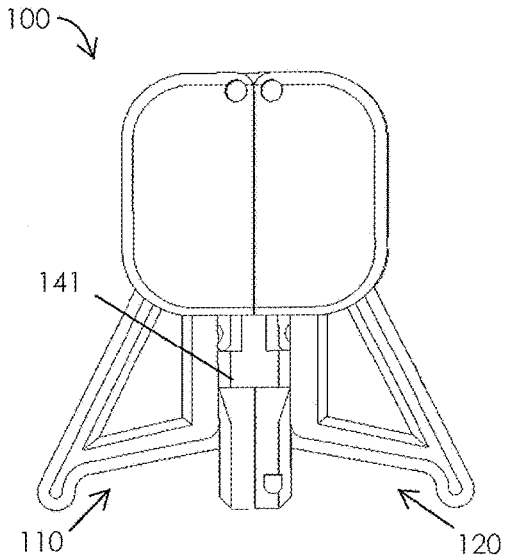
FIGS. 3C-3D show left and right side views of the hair tie holder of FIG. 1A in a closed position, in accordance with some embodiments.
Figure 3D:
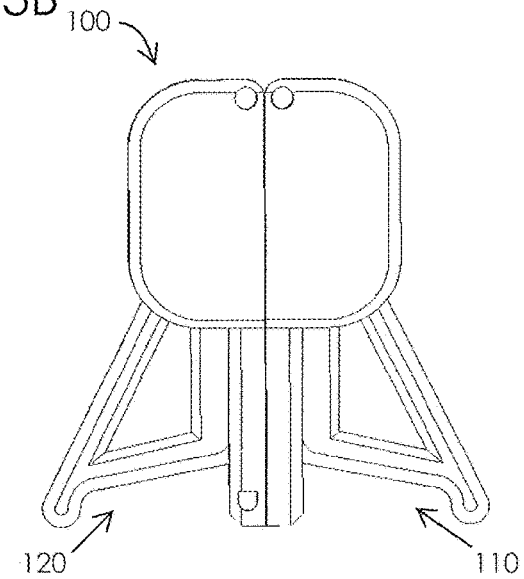

FIGS. 3A-3D shows left and right side views of the hair tie holder of FIG. 1A in an open position, in accordance with some embodiments. As can be seen in FIG. 3A, the second arm 120 includes a latch 141 on one side that pivots along an axis transverse to the direction along which the arm extends. The latch 141 is received within a corresponding latch recess 142 disposed on the corresponding side of the first arm portion 110 to secure the first and second arms into the closed position, as shown in FIG. 3C.

Figure 4A:
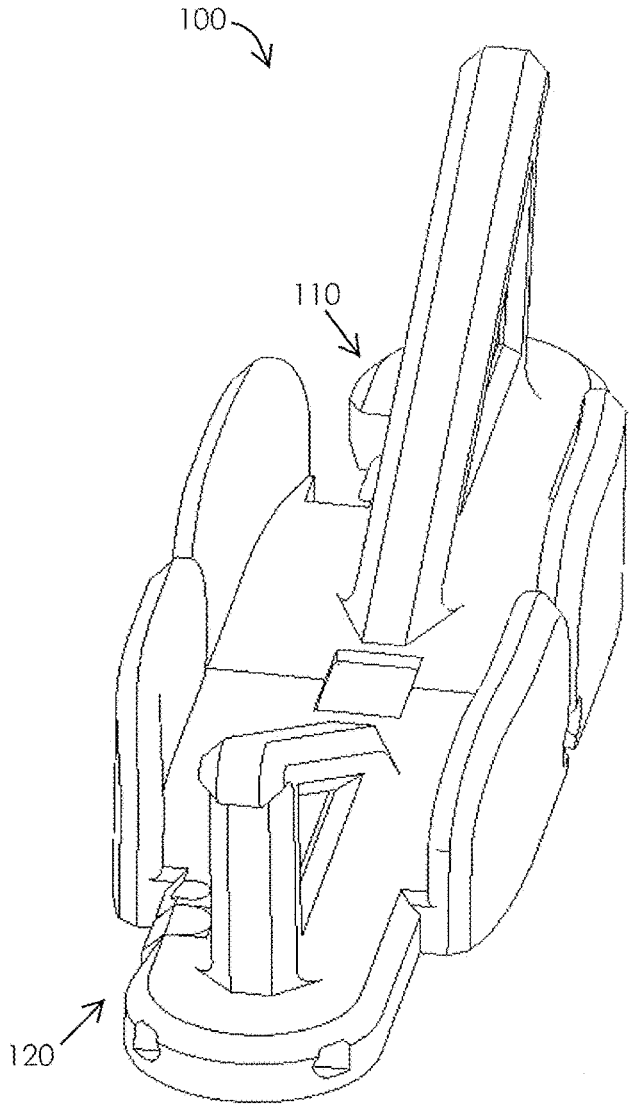
FIGS. 4A-4B show alternate top and bottom perspective views of the hair tie holder of FIG. 1A in an open position, in accordance with some embodiments.
Figure 4B:
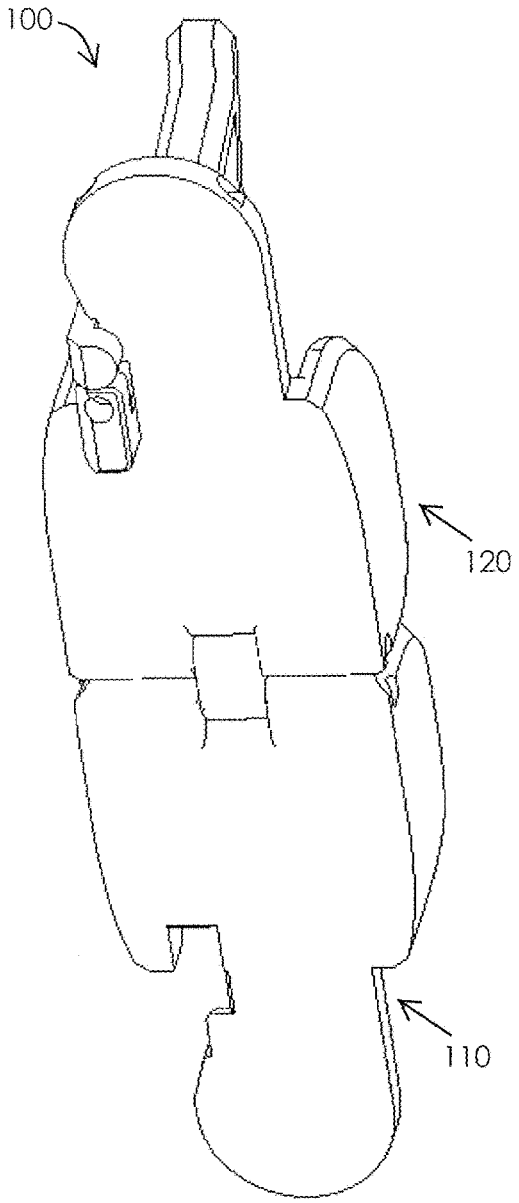

FIGS. 4A-4B show alternate top and bottom perspective views of the hair tie holder of FIG. 1A in the open position. As can be seen in FIG. 4A, each of the first and second arms 110 and 120 includes an elongate planar surface between guides 150 on either side to facilitate placement of the one or more loops along a path extending around the first and second pegs.

Figure 5A:
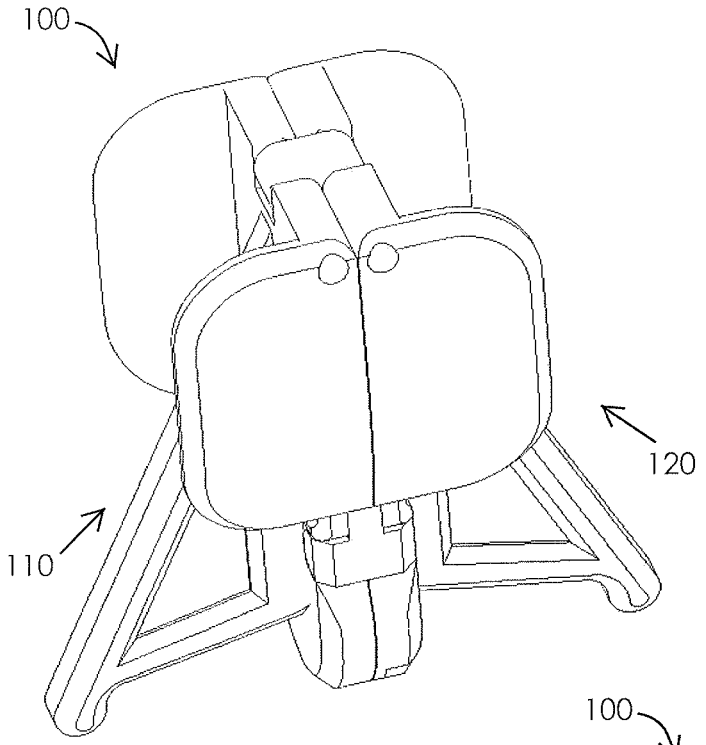
FIGS. 5A-5B show top and bottom perspective views of the hair tie holder of FIG. 1A in a closed position, in accordance with some embodiments.
Figure 5B:
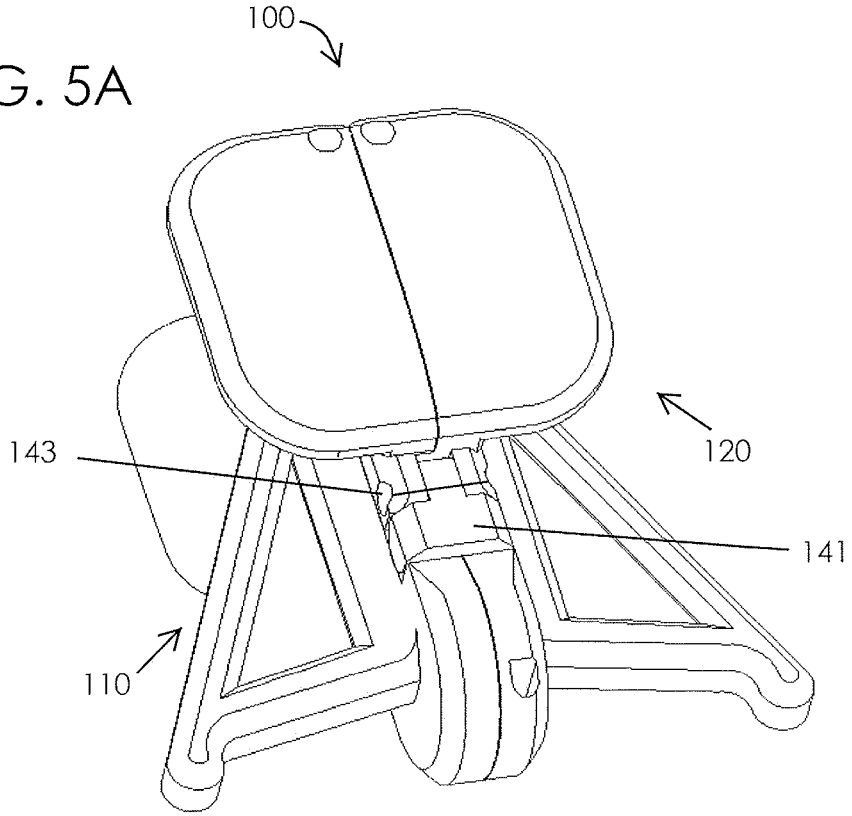
Figure 6A:
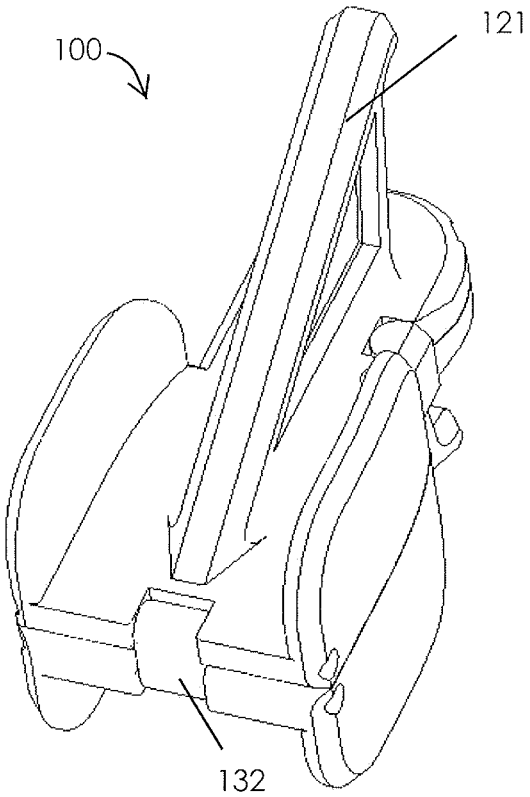
FIGS. 6A-6B show alternate top and bottom perspective views of the hair tie holder of FIG. 1A in a closed position, in accordance with some embodiments.
Figure 6B:
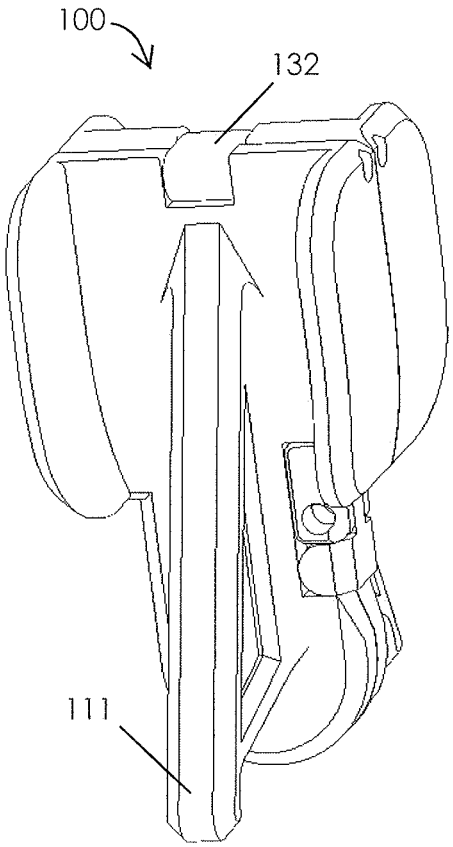
Figure 7A:
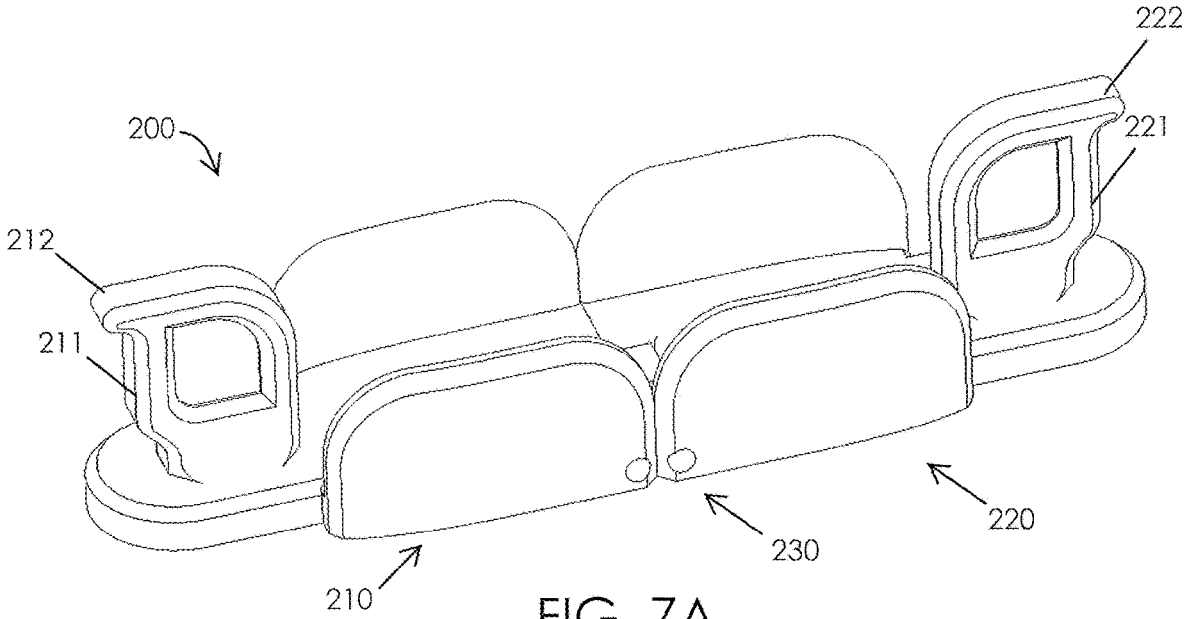
FIGS. 7A-8B show another embodiment of a hair tie holder in an open position, in accordance with some embodiments.
Figure 7B:
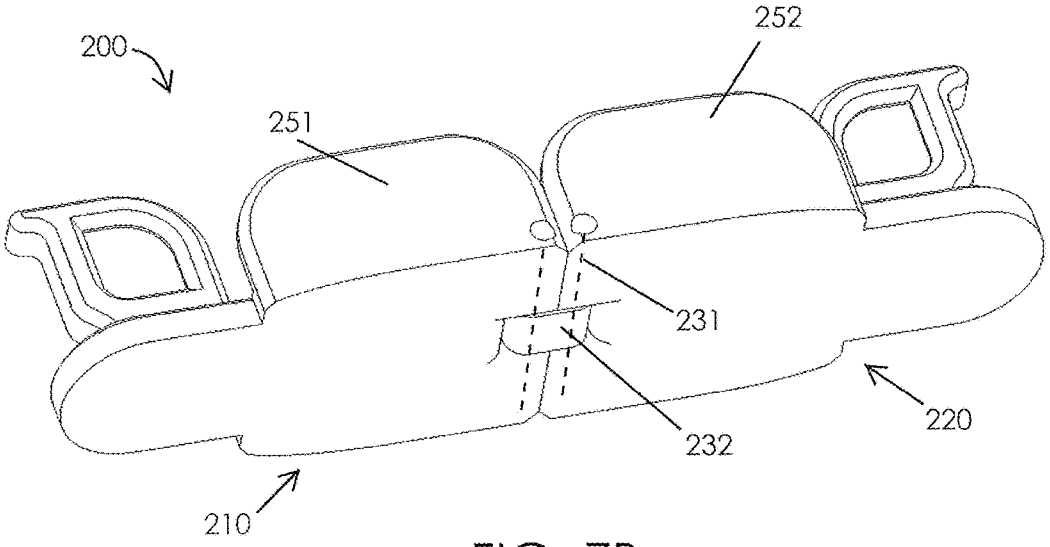
Figure 8A:
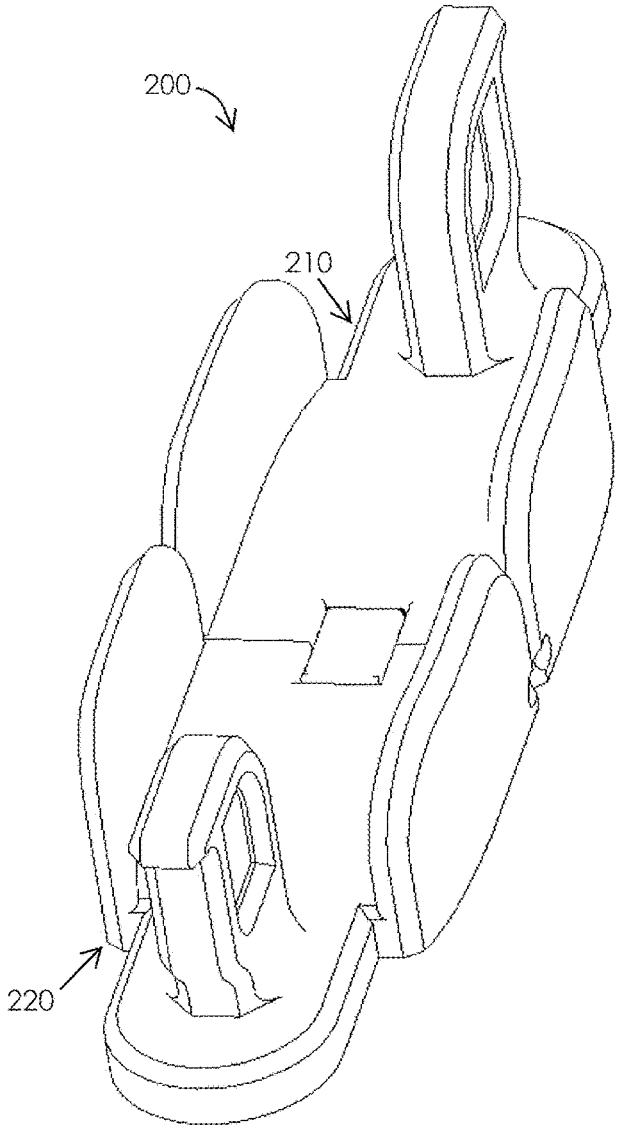
Figure 8B:
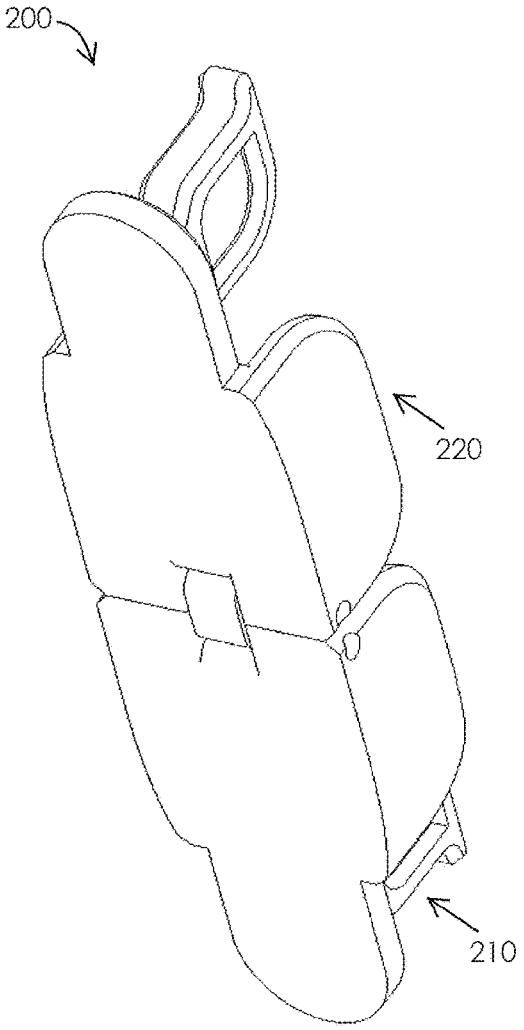

FIGS. 5A-5B show top and bottom perspective views of the hair tie holder of FIG. 1A in the closed position. As can be seen in FIG. 5B, the latch 141 fits into a latched position into latch recess 142 (for example by pivoting along latch pin 143). While a resilient latch design is shown here, it is appreciated that any suitable latch or closure mechanism could be used, including a snap-fit, friction fit, lever, or magnet. FIGS. 6A-6B show alternate top and bottom perspective views of the hair tie holder of FIG. 1A in the closed position, which illustrate the advantageous use of the floating hinge 132 in providing a compact configuration in the closed position.

FIGS. 7A-8B show another embodiment of hair tie holder device 200 in the open position. Similar to the design in FIG. 1A, holder device 200 includes first and second arm portions 210, 220 with first and second protrusions 211, 221 and lateral guides 251, 252 on each side of the first and second arms along the middle hinge portion 230, which includes parallel hinge pins 231 and a floating hinge body 232. In this embodiment, the first and second protrusions are shaped or contoured to facilitate retention of the one or more loops or bands around the protrusions. Each protrusion includes an angled distal portion 212 to further retain the loops or bands thereon. While no latch is shown here, it is appreciated that the device can further include a latch or closure means, such as any of those described herein.

Figure 9A:
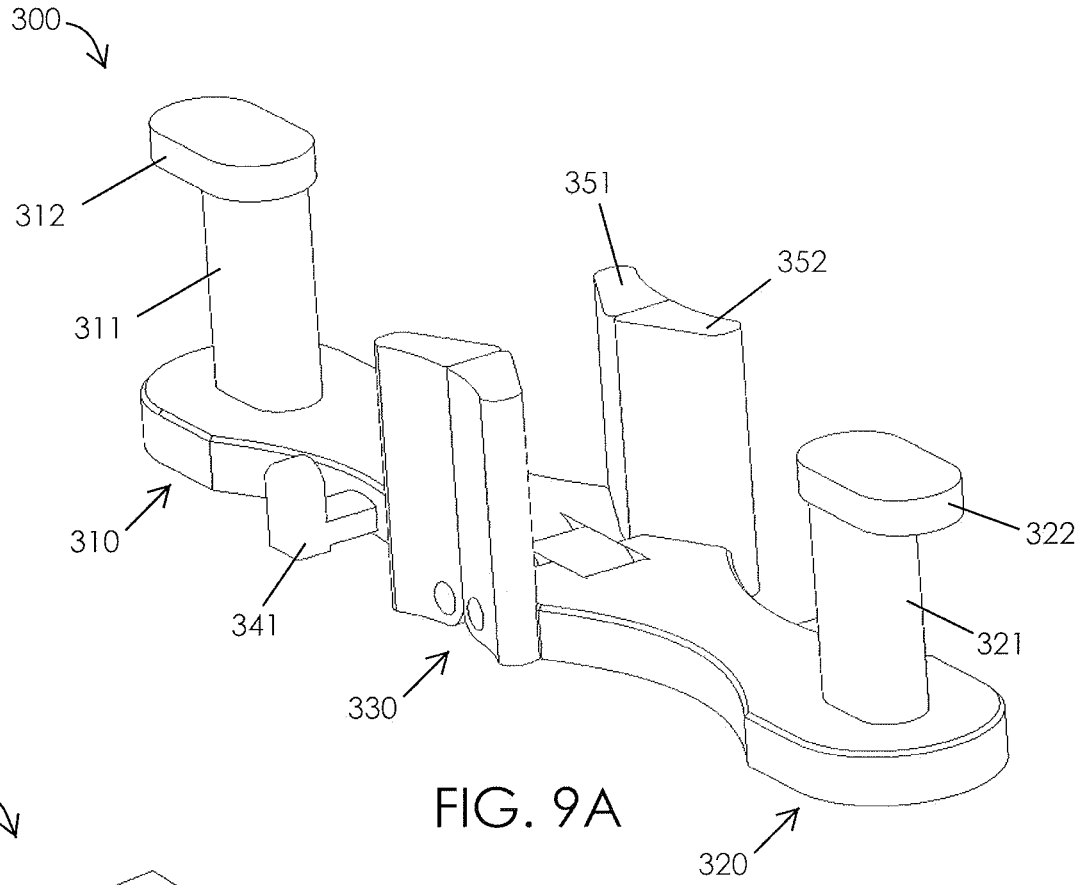
FIGS. 9A-10B show another embodiment of a hair tie holder in open and closed positions, in accordance with some embodiments.
Figure 9B:
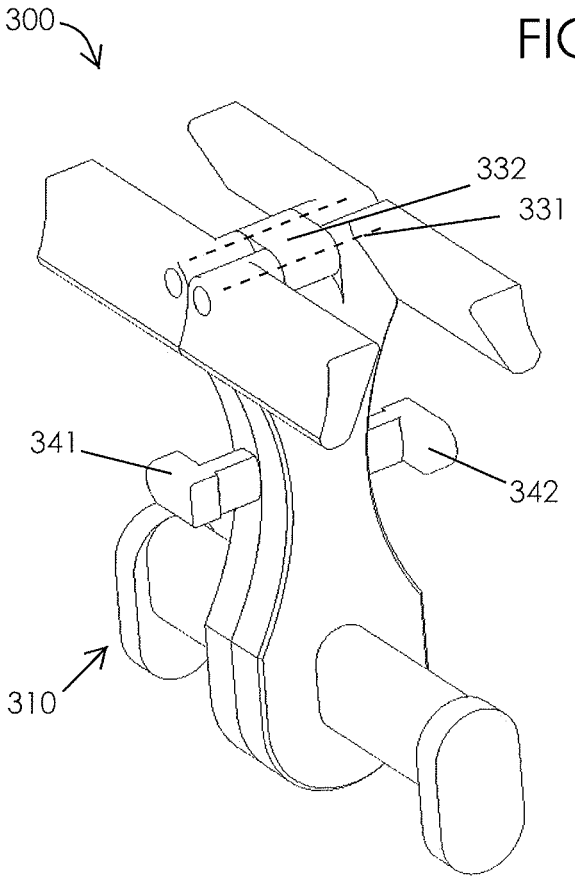
Figure 10A:
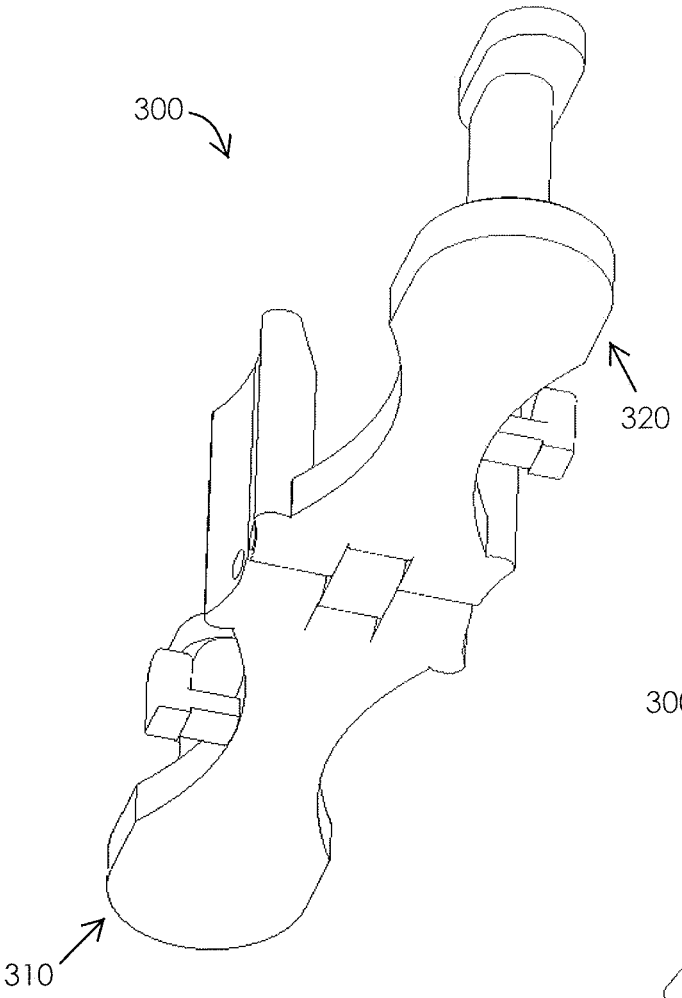
Figure 10B:
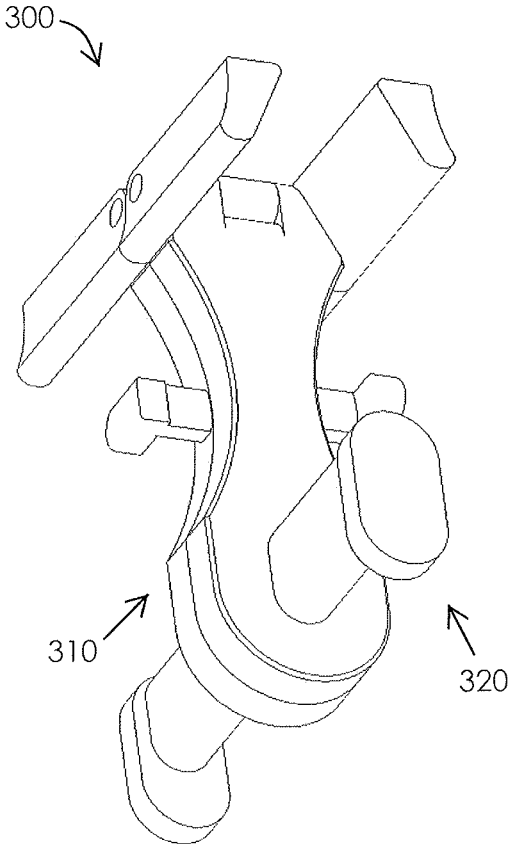

FIGS. 9A-9B show another embodiment of holder device 300 in open and closed positions, respectively. Similar to previous designs, holder device 300 includes first and second arms 310, 320 that are attached by hinge portion 330, with parallel hinge pins 331 and a floating hinge body 332, so as to be movable between the open and closed positions. First and second arms include first and second pegs 311, 321 having distal retention features 312, 322 for retaining the one or more loops on the device. The device further includes lateral guides 351, 352 on opposite sides of each arm to retain the one or more loops and inhibit rotation beyond the open position. This embodiment includes an alternative latch design having a latch members 341, 342 on opposing sides of each arm. In this design, one or more hair ties is put on the hair tie holder 300, the hair tie holder device is folded into the closed position, and one of the ties is stretched and pulled from one side arm 341 over the hook on the opposing arm 342 such that the hair tie is used to keep the hair tie holder device fastened in to the closed position. To open, the hair tie can be easily unhooked from arm 342. FIGS. 10A-10B show alternative views of holder device 300 in the open and closed positions, respectively.

Figure 11A:
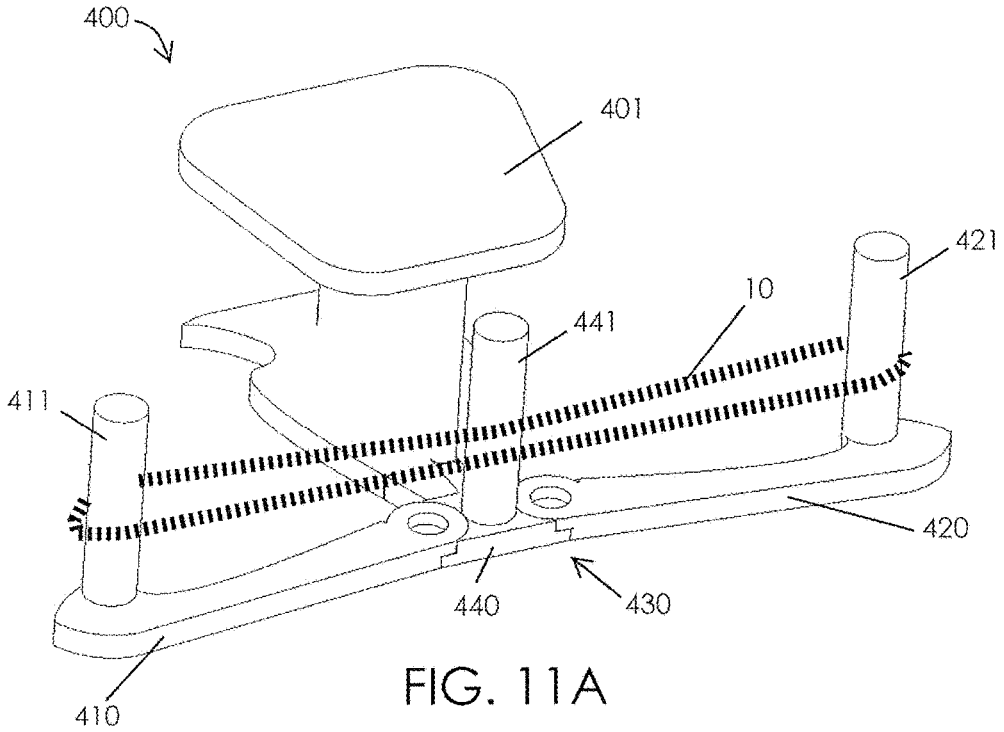
FIGS. 11A-12B show another embodiment of a hair tie holder in open and closed positions, in accordance with some embodiments.
Figure 11B:
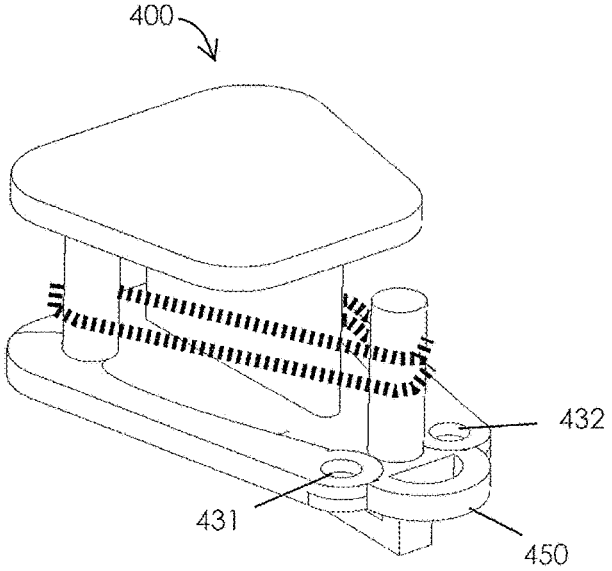
Figure 12A:
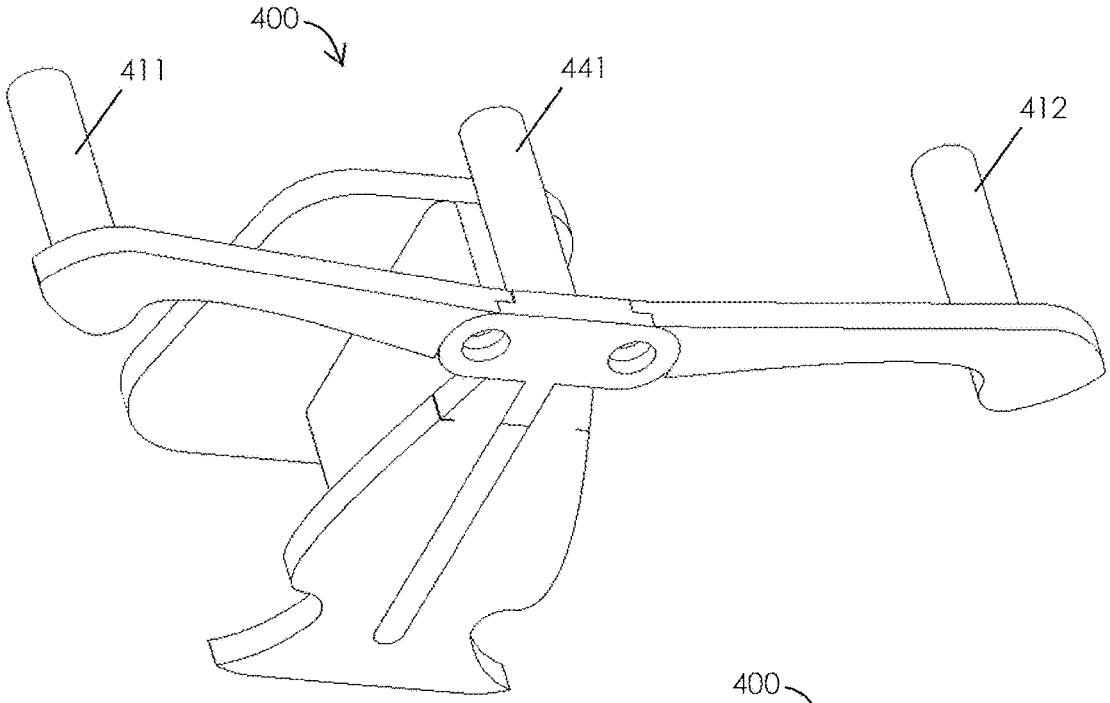
Figure 12B:
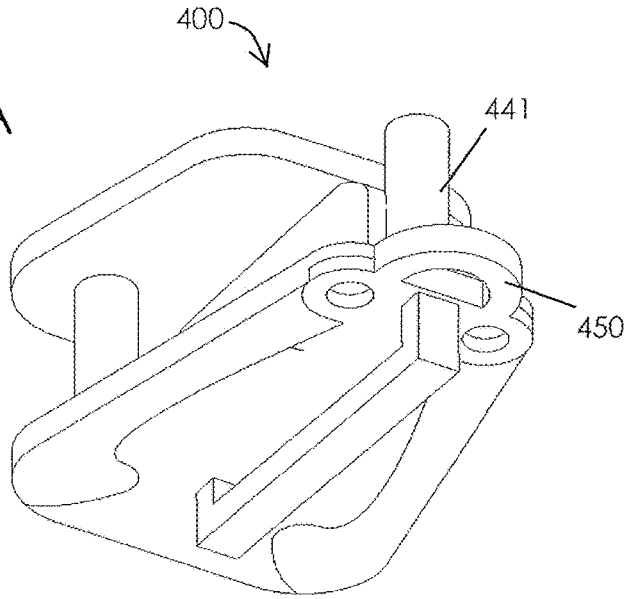

FIGS. 11A-11B show another holder device 400 in open position and closed positions, respectively. Similar to previous designs, the device includes first and second arms 410, 420 with first and second protruding pegs 411,421, the arms joined by a middle hinge portion 430. However, this hinge design includes a middle hinge body 440 from which extends a third protruding peg 441 that further defines the path between the first and second pegs 411, 421 along which the hair loops are placed. Further, middle hinge body 440 is attached to a main body 401 having sides that are contoured to fittingly receive each of the first and second arms when folded against the main body 401. Main body 401 also facilitates handling of the device. As the first and second arms 410, 420 are folded against the main body, the one or more loops extending around the first and second pegs engage against one side of the third peg 441 to fold the one or more loops into a more compact configuration. In some embodiments, the device 400 can include a portability feature, such as a hole or a loop (for example loop 450 shown in FIG. 11B), to attach to keychains, backpacks, and bags to facilitate improved portability of the device. While a latch is not shown, it is appreciated that the device 400 can further include a latch or closure means to secure the device in the closed position, such as any of those described herein. FIGS. 12A and 12B show underside views of device 400 in an open and closed position, respectively. In some embodiments, a portability feature for hanging the device can be provided on the underside, as shown in FIG. 12B.

Figure 13A:
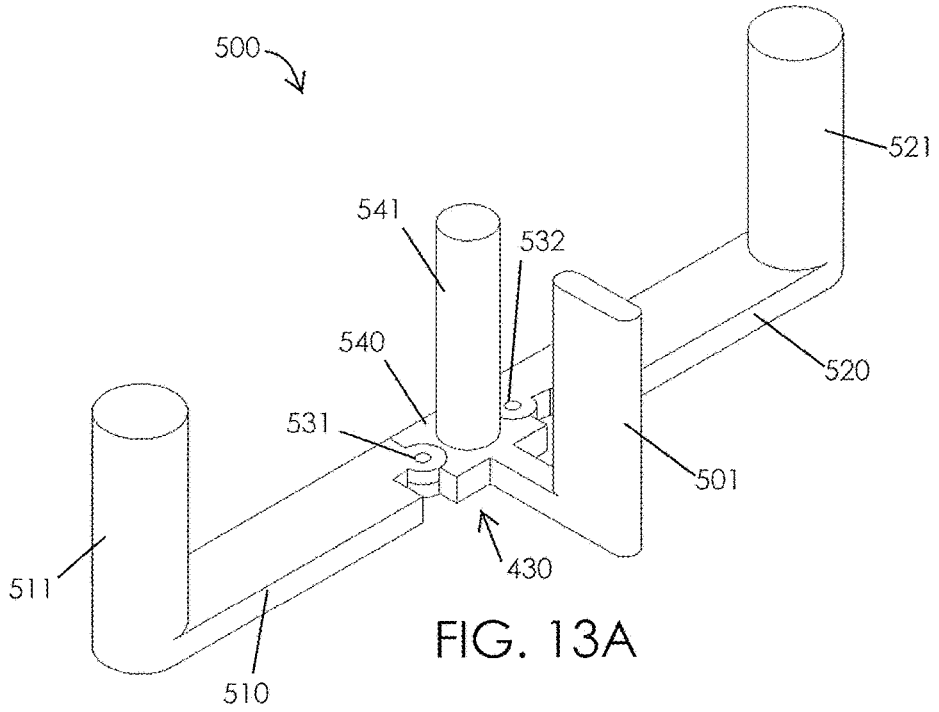
FIGS. 13A-14B show another embodiment of a hair tie holder in open and closed positions, in accordance with some embodiments.
Figure 13B:
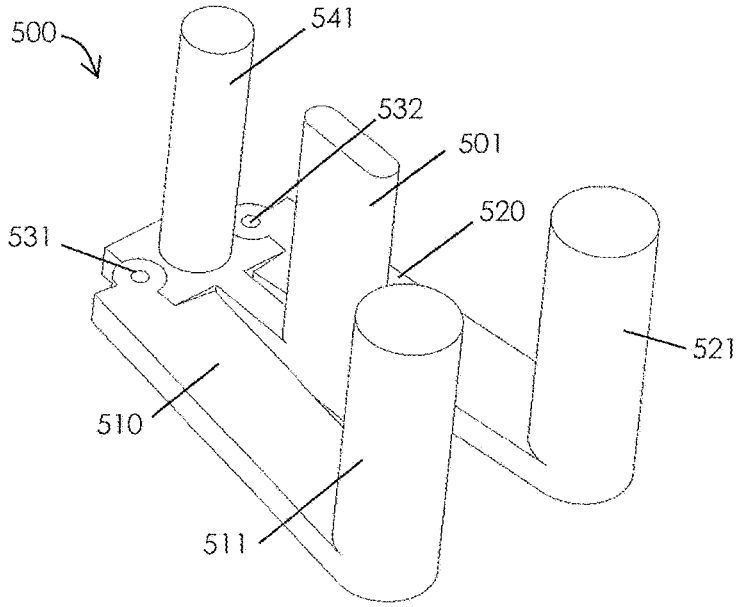
Figure 14A:
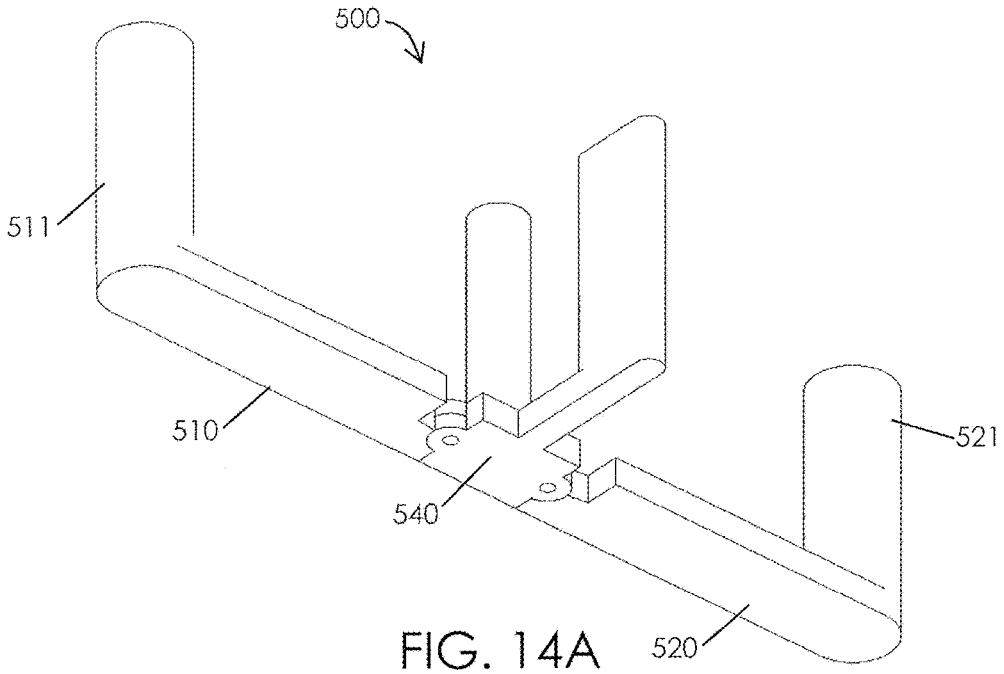
Figure 14B:
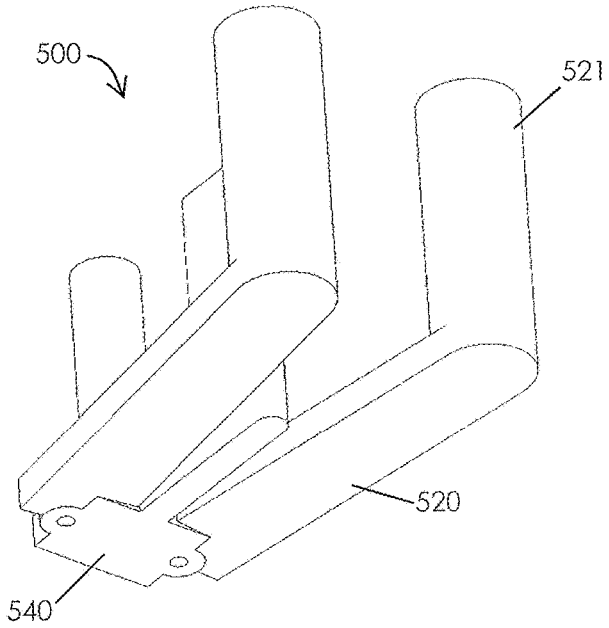

FIGS. 13A-13B show another holder device 500 in open and closed positions, respectively. Similar to the prior design, the device include first and second arms 510, 520 with first and second protruding pegs 511, 521, the arms attached by first and second pivot hinges 521, 532 to a center hinge portion 540 having a third protruding peg 541 and connected to main body 501. This design functions in a manner substantially the same as the prior design of FIG. 11A. It is appreciated that this design can further include a latch or closure means and/or a portability feature, such as any of those described herein. FIGS. 14A and 14B show underside views of device 500 in an open and closed position, respectively.

Figure 15A:
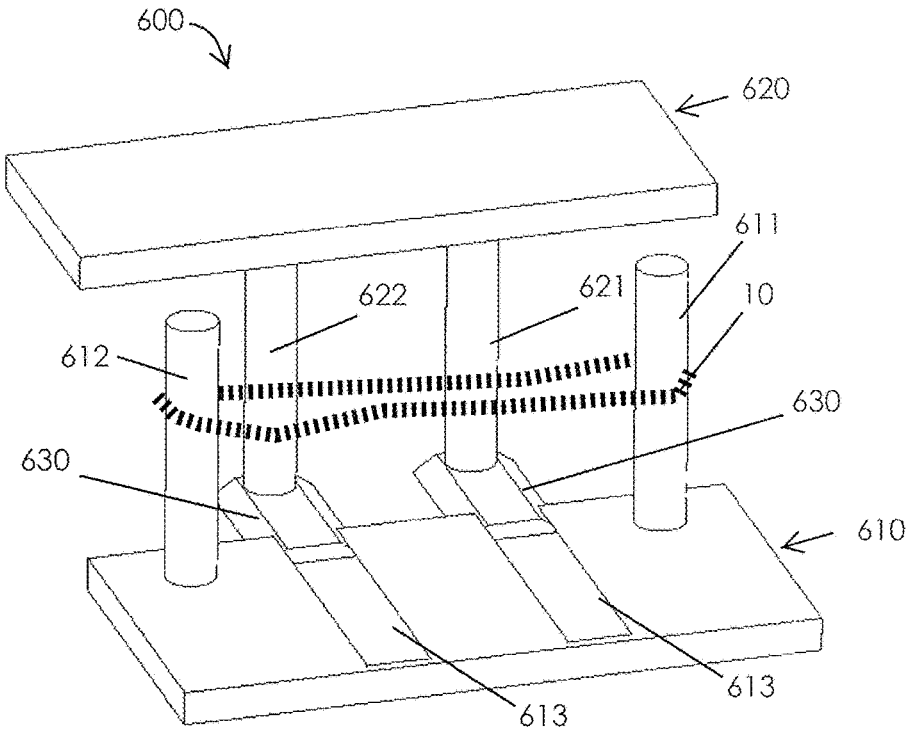
FIGS. 15A-16B show another embodiment of a hair tie holder in open and closed positions, in accordance with some embodiments.
Figure 15B:
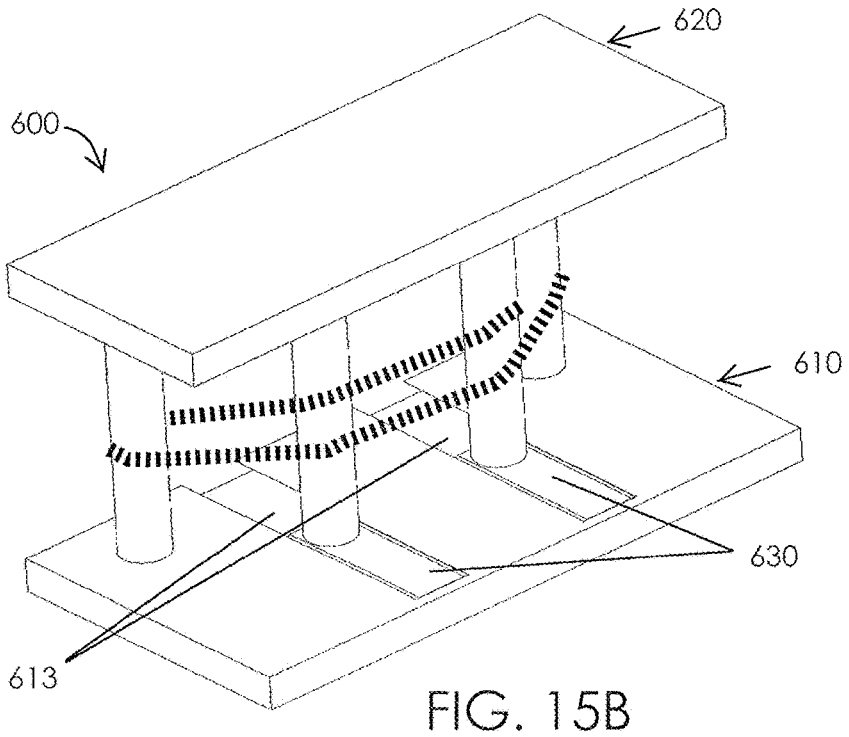
Figure 16A:
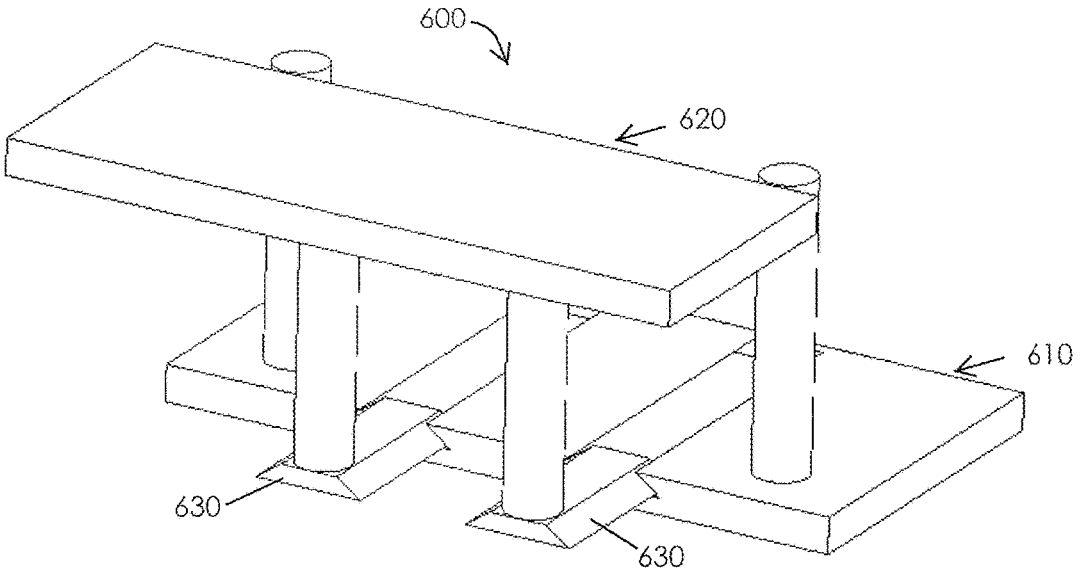
Figure 16B:
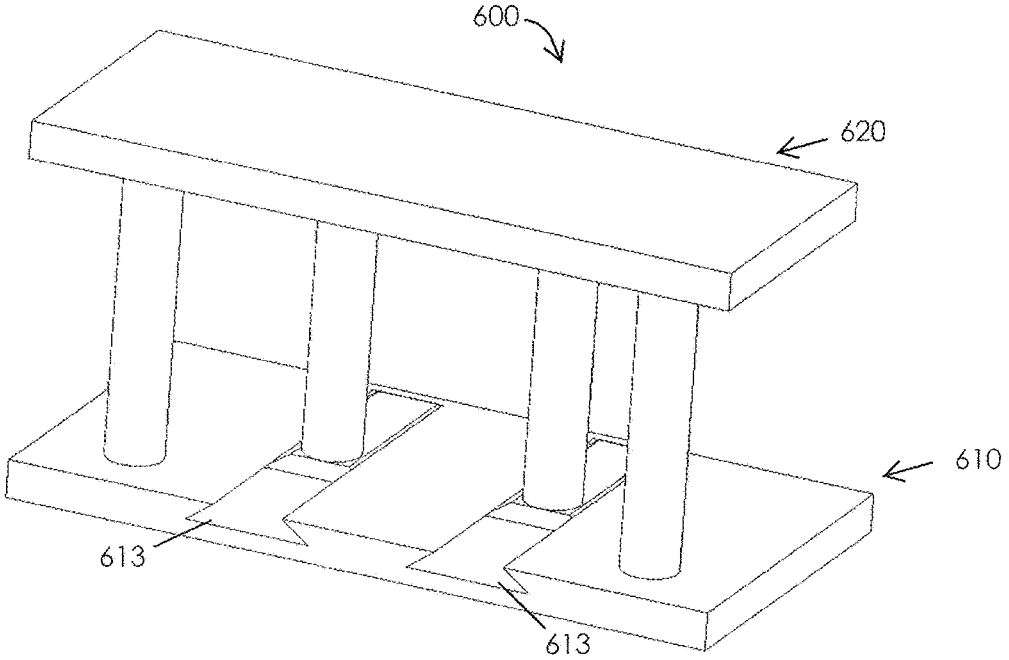

FIGS. 15A-15B show another holder device 600 in open position and closed positions, respectively. This design includes first and second plates 610, 620 that are parallel and separated by multiple pegs protruding from each plate. First plate 610 includes first and second protruding pegs 611, 612 around which one or more loops are placed. Second plate 620 includes third and fourth protruding pegs 621, 622 that are interfaced by sliding features 630 that slide within corresponding tracks 613 defined within first plate 610. After the one or more loops are placed over the first and second pegs 611, 612 of first plate 610, as shown in FIG. 15A, the second plate 620 is slid into the closed position so that the third and fourth pegs 621, 622 engage the one or more loops and draw the one or more loops taut. It is appreciated that this design can further include a latch or closure means and/or a portability feature, such as any of those described herein. FIG. 16A-16B show underside views of device 600 in an open and closed position, respectively.

Figure 17A:
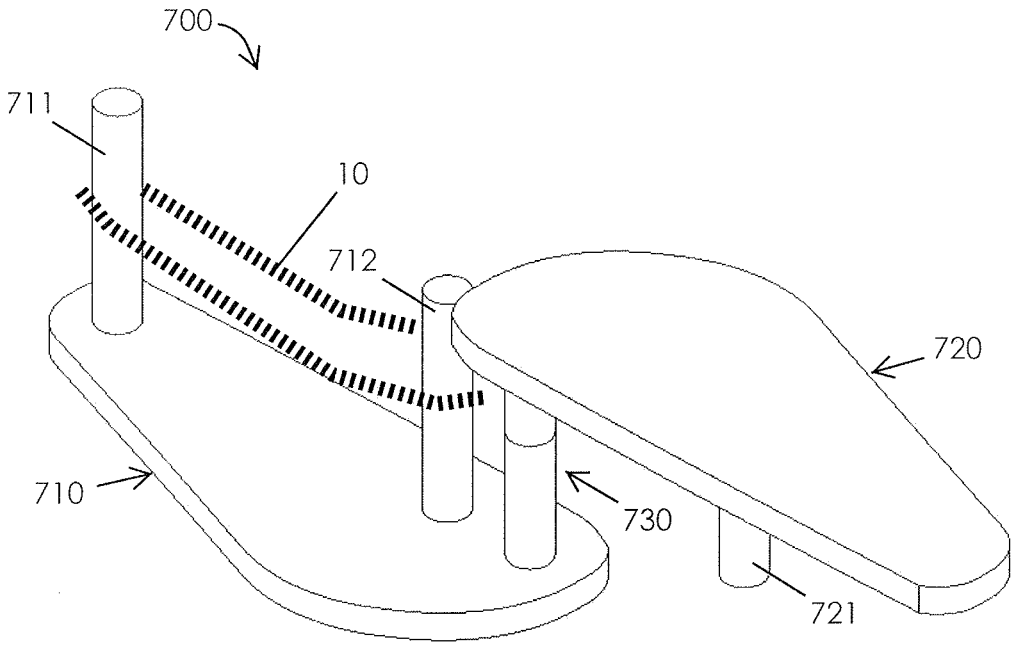
FIGS. 17A-18B show another embodiment of a hair tie holder in open and closed positions, in accordance with some embodiments.
Figure 17B:
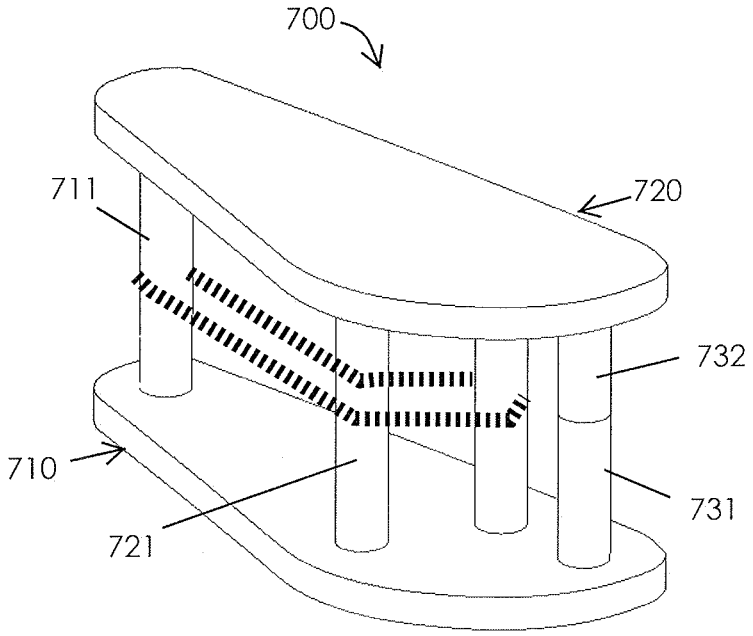
Figure 18A:
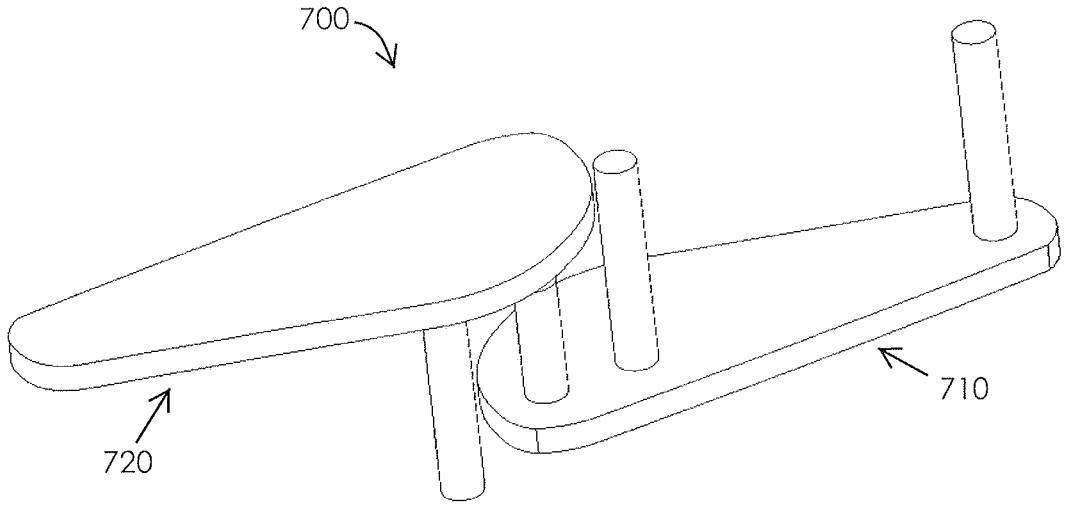
Figure 18B:
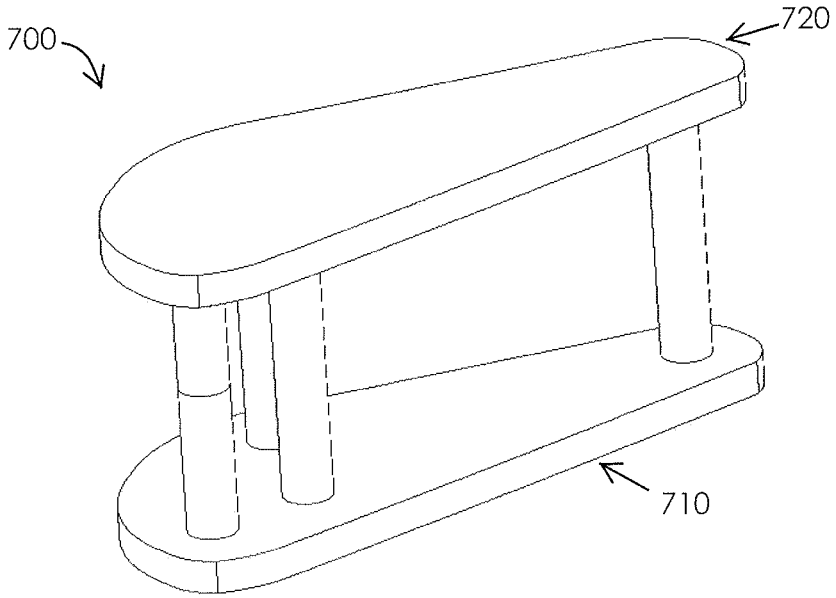

FIGS. 17A-17B show another holder device 700 in open position and closed positions, respectively. This design includes first and second plates 710,720 that are parallel and separated by multiple pegs protruding from each plate. First plate 710 includes first and second protruding pegs 711, 712 around which one or more loops 10 are placed. Second plate 720 includes a third protruding peg 721. Second plate 720 is movably attached to first plate 710 by a peg-like pivot hinge 730 such that second plate 720 rotates or pivots from the open position (see FIG. 17A) to the closed position (see FIG. 17B). After the one or more loops are placed around the first and second pegs 711, 712 of first plate 710, as shown in FIG. 17A, the second plate 720 is rotated into the closed position so that the third peg 721 engages the one or more loops and draws the one or more loops taut. It is appreciated that this design can further include a latch or closure means to maintain the first and second plates in the closed position and/or a portability feature, such as any of those described herein. FIGS. 18A-18B shows alternate views of device 700 in an open and closed position, respectively.

FIGS. 18A-18B shows alternate views of device 700 in an open and closed position, respectively. In some embodiments, the first and second portions can be defined as extending/retracting portions moving from a retracting position for placement of hair ties thereon and an extended position to draw the one or more hair ties taut for storage.

Figure 19A:
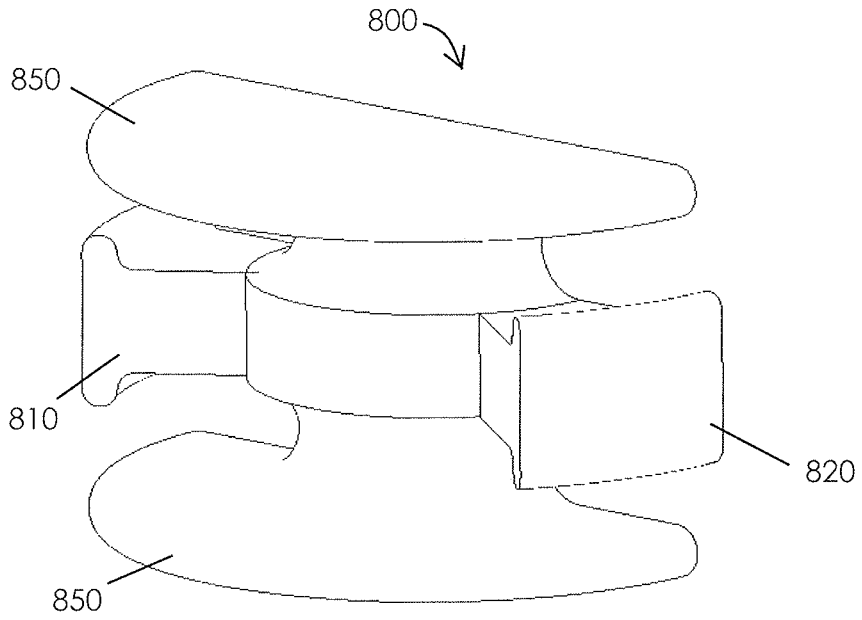
FIGS. 19A-19B show another embodiment of a hair tie holder, in accordance with some embodiments.
Figure 19B:
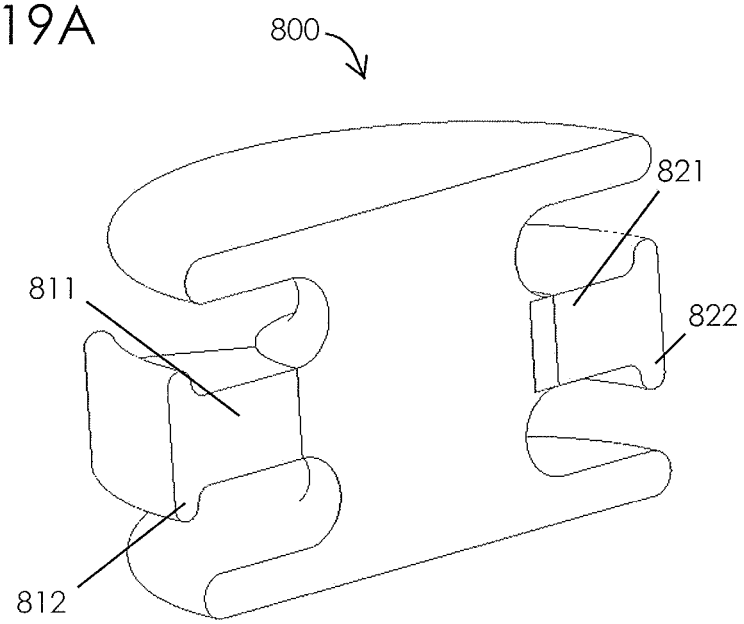

FIGS. 19A-19B show another embodiment of a holder device 800, in accordance with some embodiments. This design includes first and second protrusions 810, 820 around which one or more loops can be placed, and lateral guides 850 on opposing sides to retain the one or more loops in place. In some embodiments, the holder device is configured and dimensioned such that the hair loops are held taut between the first and second protrusions without any moving parts. In other embodiments, the first and second protrusions are defined as first and second arms that can be moved away from each other so as to draw the one or more loops taut. It is appreciated that this design can further include a latch to maintain the first and second plates apart if needed and/or a portability feature, such as any of those described herein.

Figure 20A:
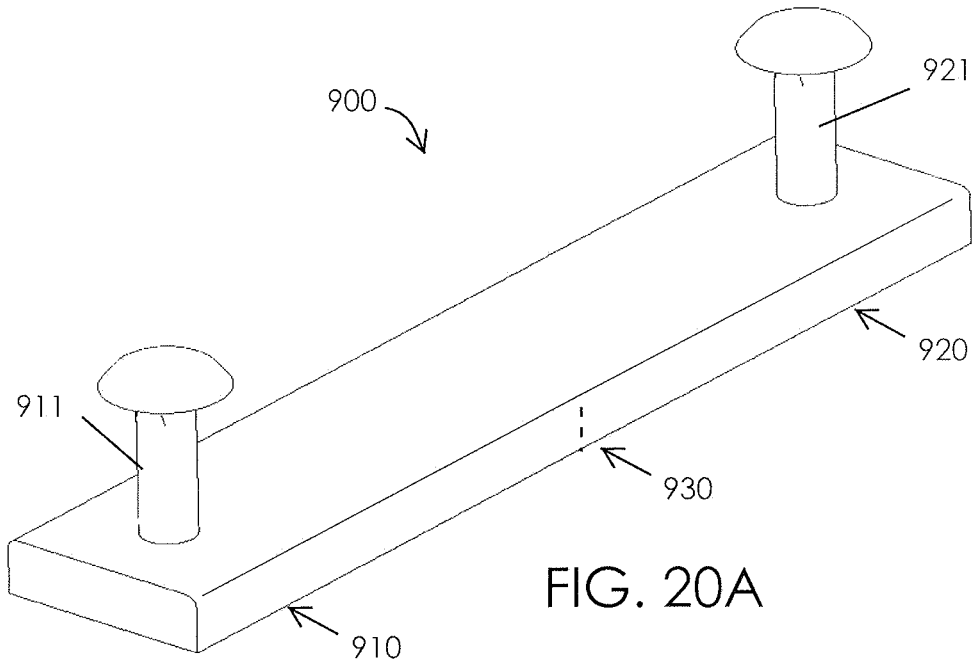
FIGS. 20A-20B show another embodiment of a hair tie holder, in accordance with some embodiments.
Figure 20B:
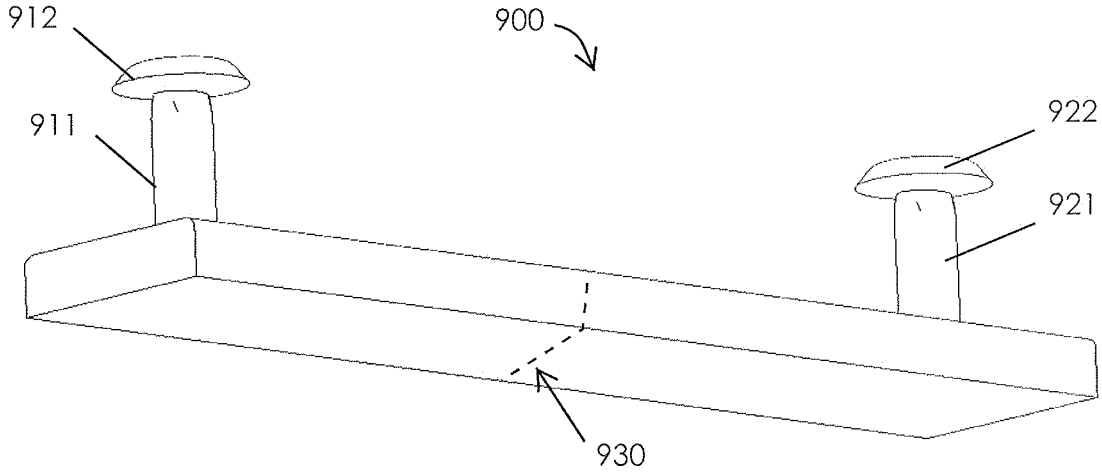

FIGS. 20A-20B show another holder device 900, in accordance with some embodiments. In this design, the first and second arms portions 910, 920 are defined within an elongate member. In some embodiments, this elongate member is defined within a single unitary component. The first and second portions 910, 920 include first and second protruding pegs 911, 921 with distal retention features 912, 922 to retain the one or more loops when placed around the first and second pegs. In some embodiments, the device is configured and dimensioned to hold the one or more loops without any moving parts. In some embodiments, the first and second portions are movable relative each other, such as by a flexible or hinged portion 930. The hinged portion 930 can be a thinned portion that flexes to allow for bending movement, or can utilize any suitable hinge, such as any of those described herein. It is appreciated that this design can further include a latch or closure means to maintain the first and second plates in the closed position and/or a portability feature, such as any of those described herein.

Figure 21A:
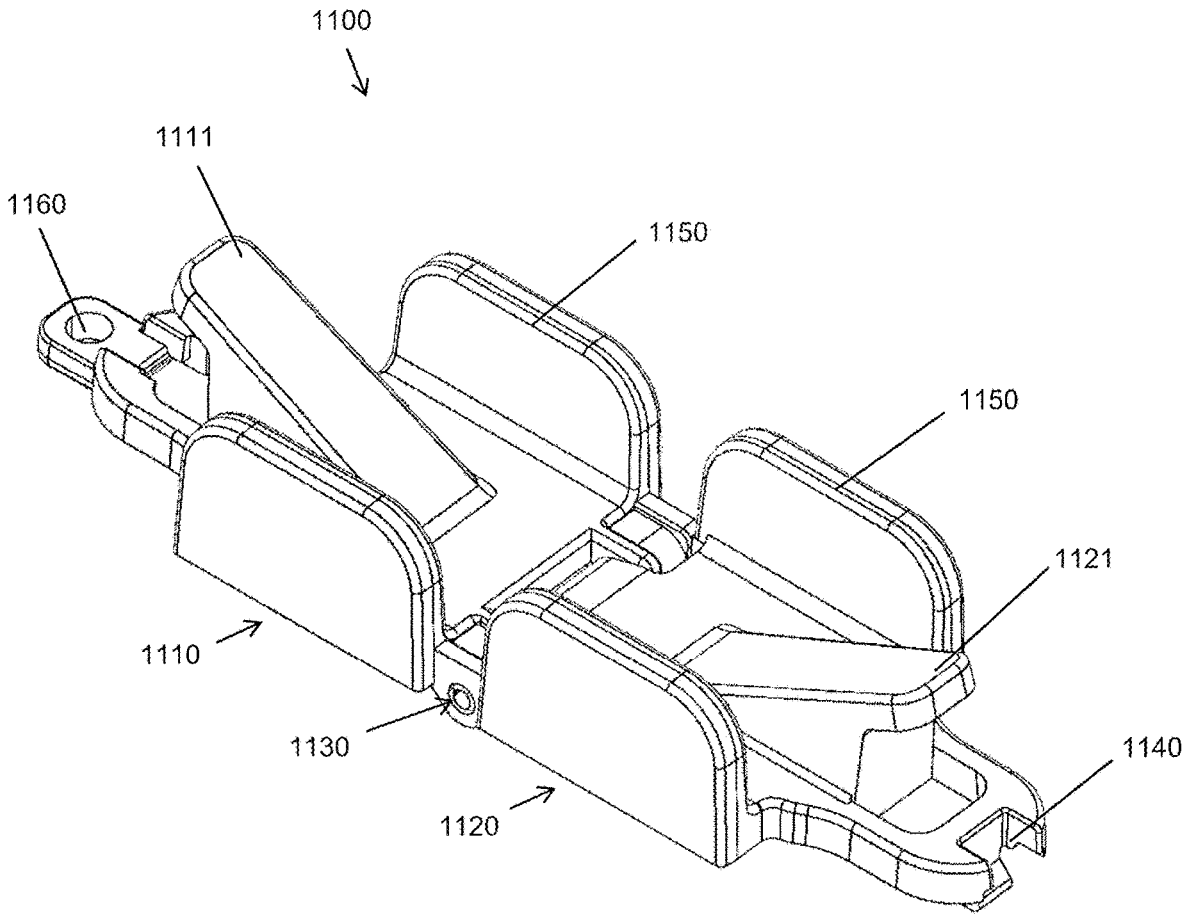
FIGS. 21A-21J show another embodiment of a hair tie holder, in accordance with some embodiments.
Figure 21B:
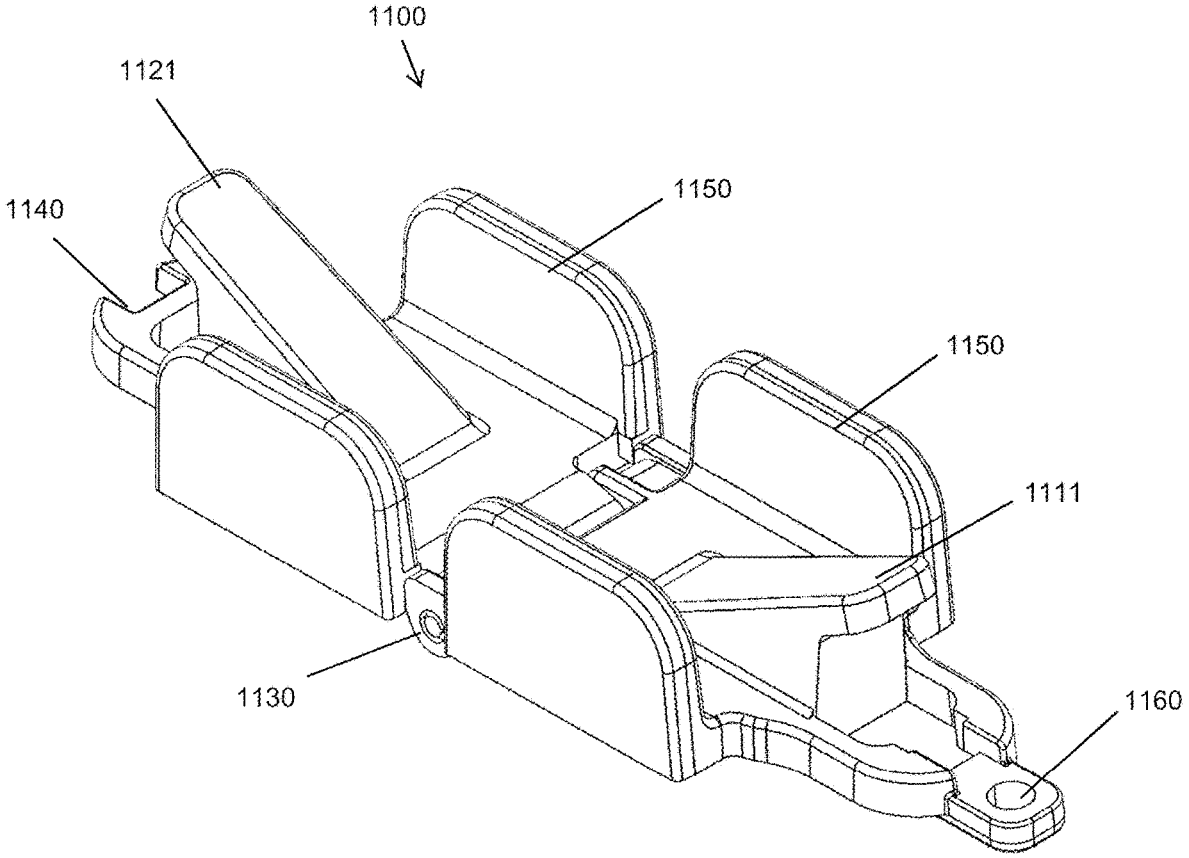
Figure 21C:
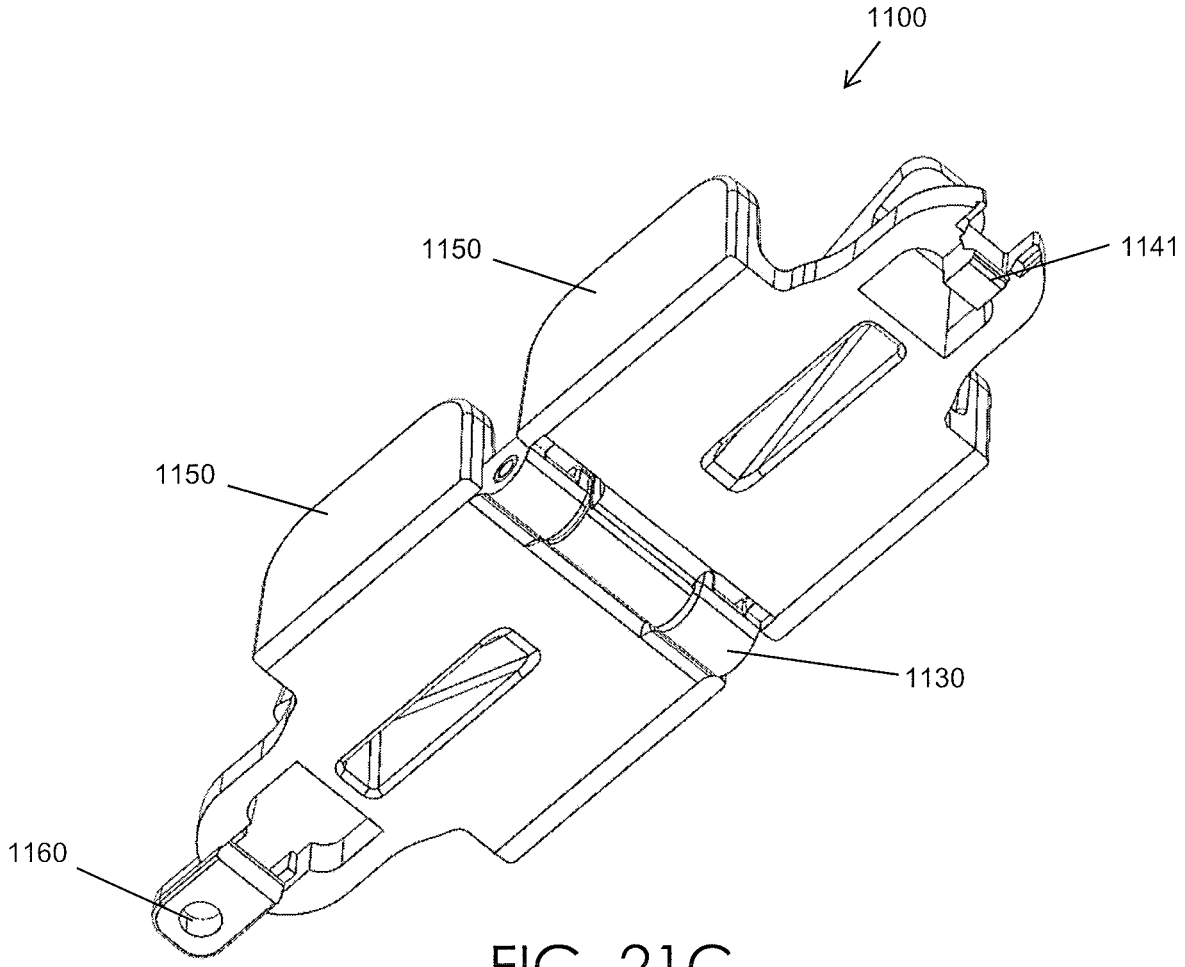
Figure 21D:
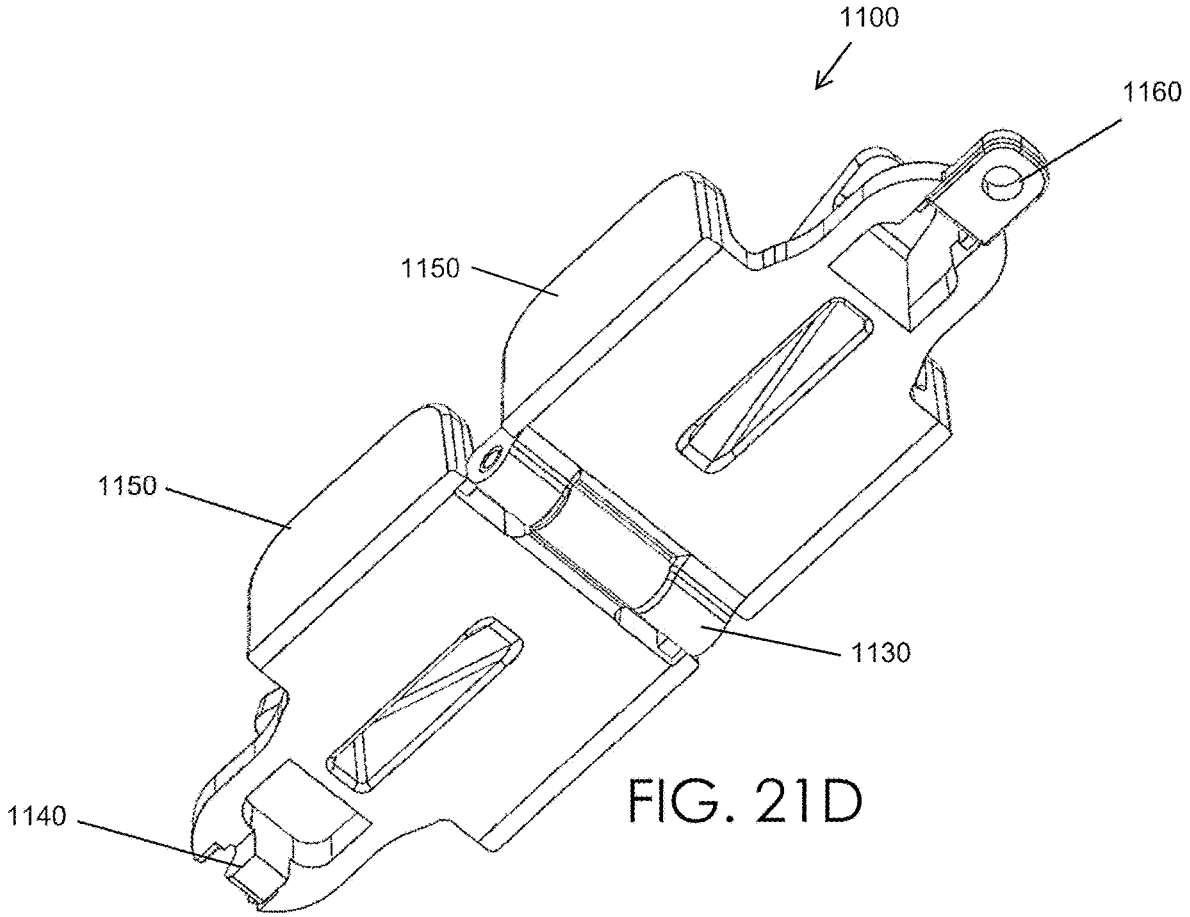
Figure 21E:
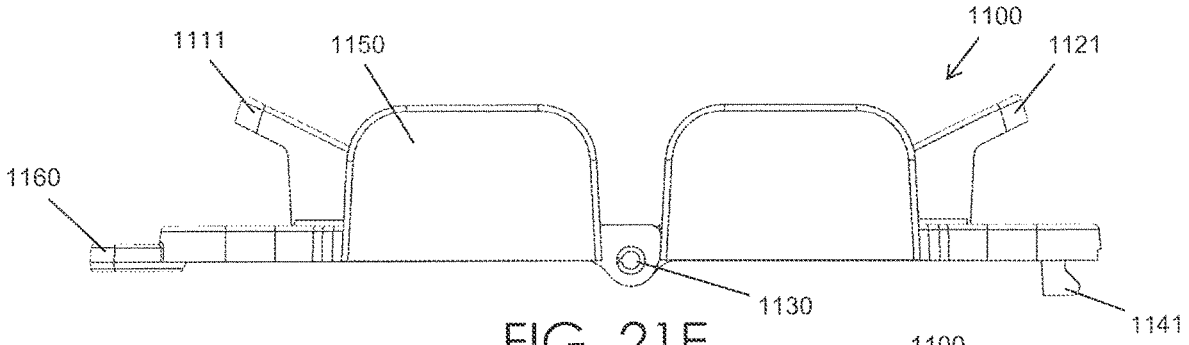
Figure 21F:
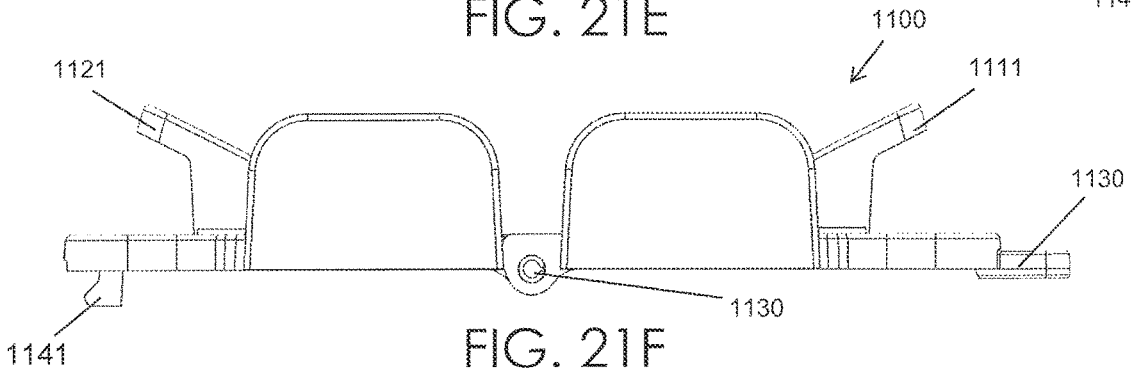
Figure 21G:
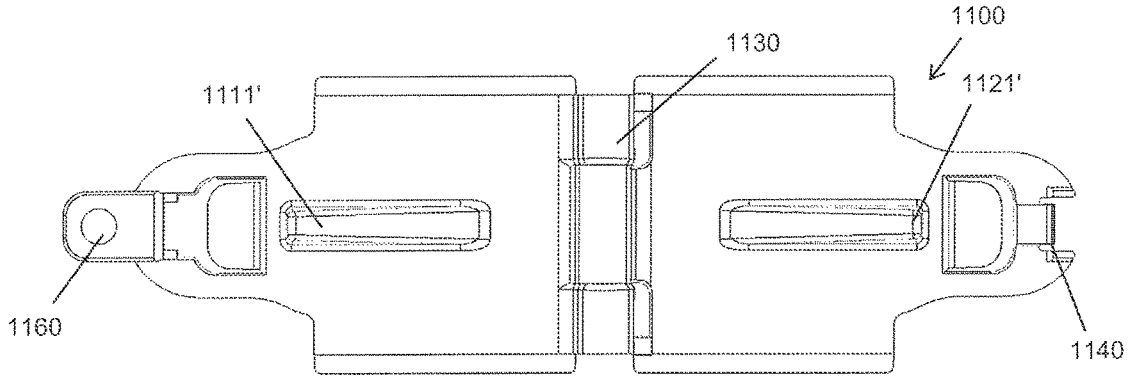
Figure 21H:
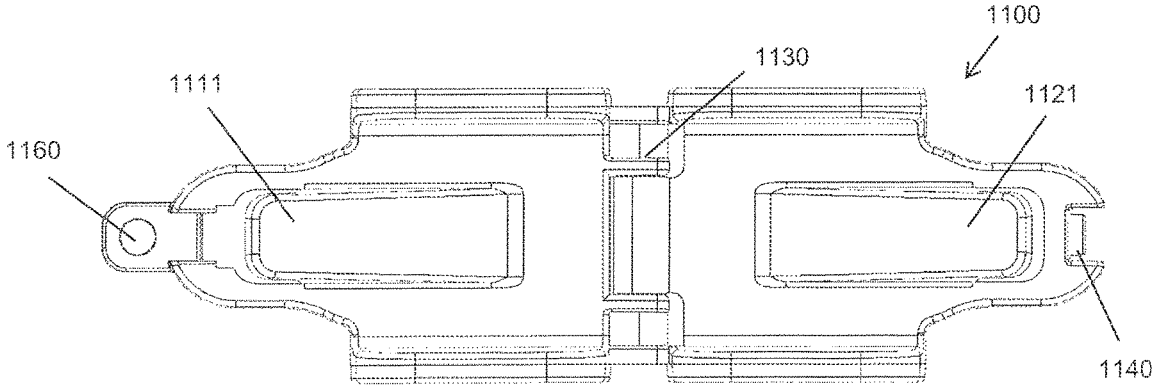
Figure 21I:
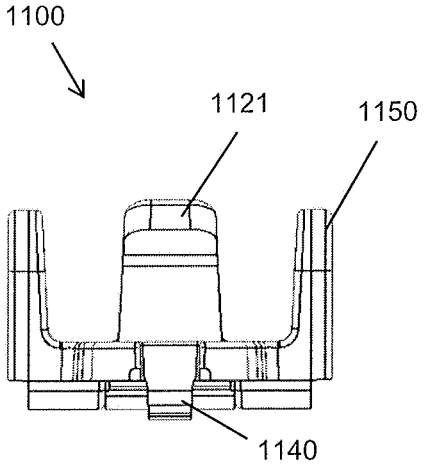
Figure 21J:
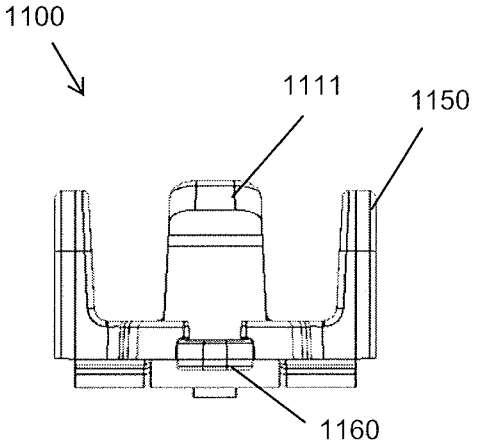

FIGS. 21A-J and 22A-2B show various views of another embodiment of a holder device 1100 having first and second portions (e.g. arms 1110, 1120) joined at a hinged middle portion 1130 such that the device can be folded between an open position (see FIG. 22A) to facilitate placement of one or more hair ties 10 thereon and a closed position (see FIG. 22B) to secure and hold the one or more hair ties 10 drawn taut. Each arm 1110, 1120 includes an upwardly extending protrusion 1111, 1121 (e.g. peg, angled bracket, knob) near an end portion. In this embodiment, each protrusion further includes an inwardly angled support member that improves the strength of each peg and facilitates handling of the device. Each arm portion can further include two opposing guidewalls or guides 1150 that help retain or hold the hair ties and prevent them from falling off the sides when the device is folded from the open position to the closed position. The device can further include a fastener 1140 or any suitable means for releasably securing the device in the closed position, and can further include a portability feature 1160. As can be seen in FIG. 21G, which shows the underside of the device in the open configuration, the protrusions or pegs can be hollow such that interiors 1111' and 1121' are accessible from the underside. This construction lends itself to injection molded fabrication of the device. It is appreciated that any of the embodiments herein can be formed of a rigid or semi-rigid material, and can be formed of plastic or any suitable material, and can be manufactured by injection molding or any suitable technique.

In the embodiment shown, the hinge is a barrel hinge or butt hinge (similar to a door hinge) in which a single hinge pin is encased within alternating barrels or conduit portions to allow hinged movement of the first and second portions relative to each other. It is appreciated that any suitable hinge construction could be used, including but not limited to any of the hinges described herein.

In this embodiment, the fastener 1140 includes a downwardly extending tab 1141 that is shaped to be resiliently received within a corresponding notch on the opposing arm when the device is placed into the closed configuration. While a particular fastener configuration is shown here, it is appreciated that any fastener or latch mechanism can be used, including any of those described herein or any suitable fastener construction.

In one aspect, the lateral guides can be designed to engage each other to prevent rotation beyond the open position such that the full range of movement of the hinge is substantially between the open position and the closed position. An example of this approach is shown in the embodiment in FIGS. 23A-23B. Alternatively or in addition, one or both of the first and second portions of the device can include an additional "stopper" feature that is defined by a shaped surface that engages a surface of the other portion so as to prevent rotation beyond the open position. An example of this approach is the shape of the hinge shown in the embodiment in FIGS. 22A-22B, specifically a distally extended portion of the hinge component of one portion is flat (see FIG. 22B) so as to engage with a corresponding surface of the hinge component of the other portion, thereby preventing excessive range of motion in one direction. It is appreciated that such features could be utilized in any embodiment described herein.

Figure 22A:
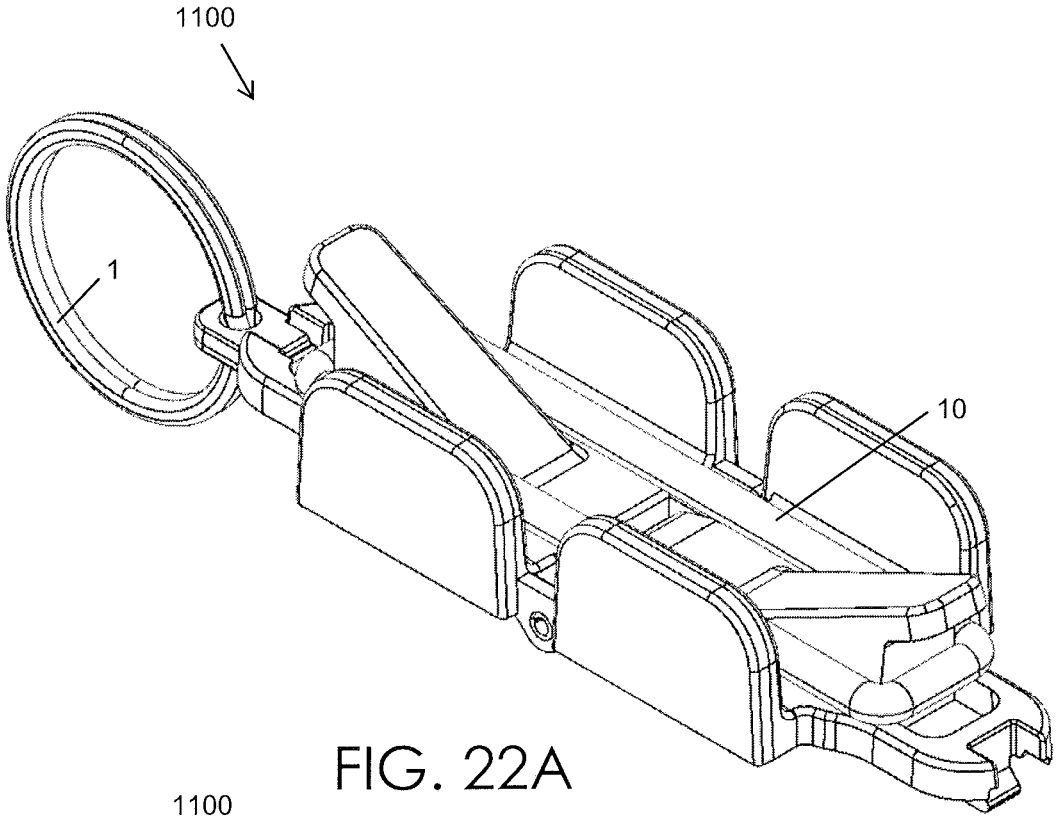
FIGS. 22A-22B show the embodiment of FIG. 21A in the open and closed configuration with a hair tie placed thereon, in accordance with some embodiments.
Figure 22B:
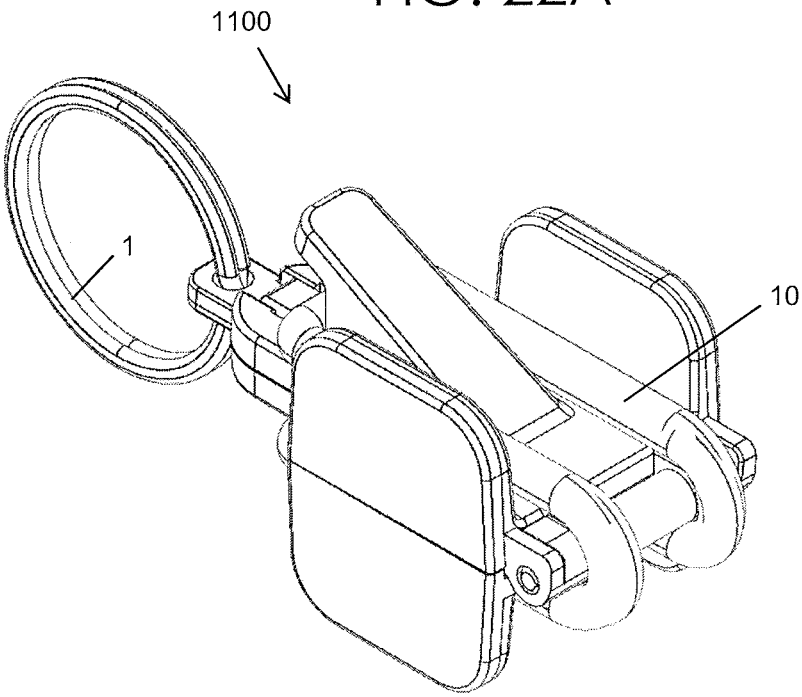

As can be seen in FIGS. 22A-22B, a hair tie 10 is placed over the two protruding pegs 1111, 1121 with the device in the open position in which the protruding pegs are easily accessible from one side of the device, as shown in in FIG. 22A. The device is then folded (see arrow) into the closed position and secured by latch 1140, as shown in FIG. 22AB, holding the hair tie taut in a compact configuration for storage. To remove the hair tie, the user unlatches and opens the device to allow ready removal of one or more hair ties from the protruding pegs. In this embodiment, the holder device further includes a portability feature 1160, such as a hole, to attach to a keychain ring 1. It is appreciated that the device can be made without this feature, however, or could include a similar feature located elsewhere on the device.

Figure 23A:
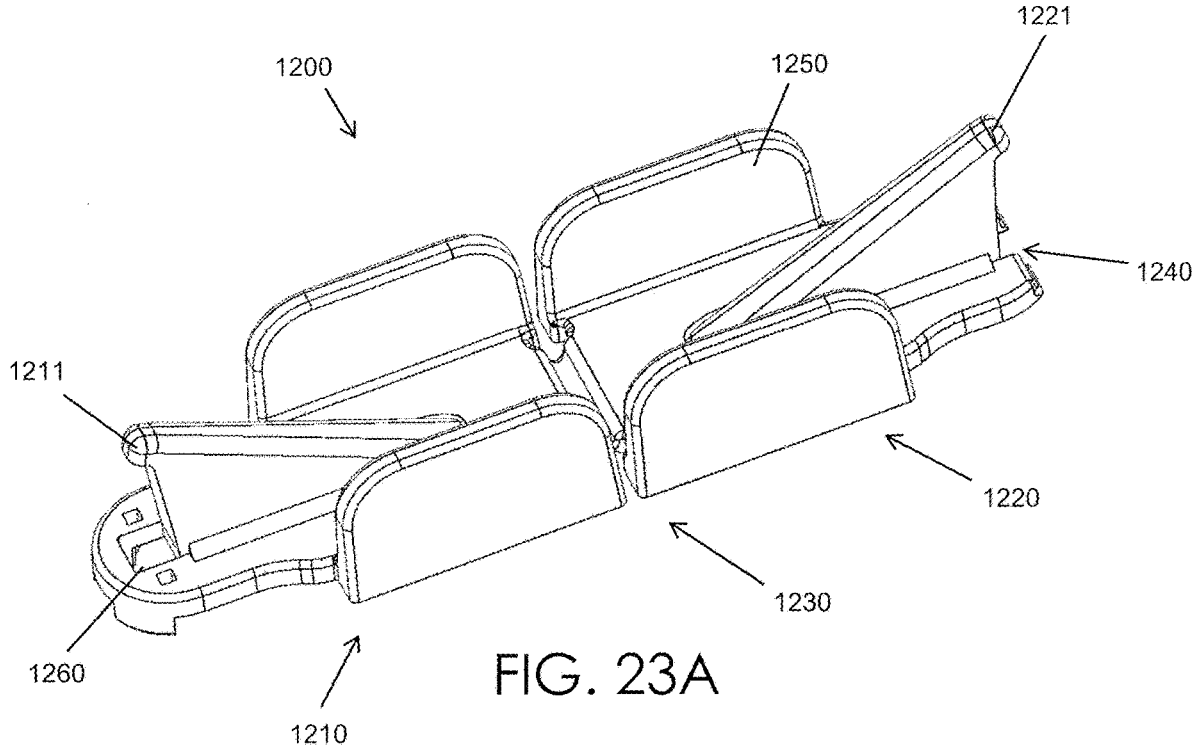
FIGS. 23A-23B show another embodiment of a hair tie holder, in accordance with some embodiments.
Figure 23B:
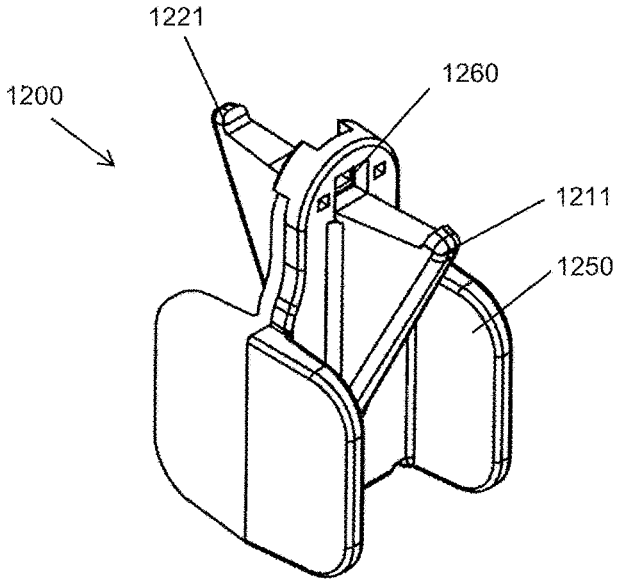

FIGS. 23A-23B show another embodiment of a holder device 1200 in an open and closed configuration, respectively. Holder device 1200 has first and second portions (e.g. arms 1210, 1220) joined at a hinged middle portion 1230 such that the device can be folded between an open position, as shown in FIG. 23A, to facilitate placement of one or more hair ties 10 thereon and a closed position, as shown in FIG. 23B, to secure and hold the one or more hair ties 10 drawn taut. Each arm 1210, 1220 includes an upwardly extending protrusion 1211, 1221 (e.g. peg, angled bracket) near an end portion. Each protrusion further includes an inwardly angled support member that improves the strength of each peg and facilitates handling of the device. Each arm portion can further include two opposing guidewalls or guides 1250 that help retain or hold the hair ties and prevent them from falling off the sides when the device is folded from the open position to the closed position. The device can further include a fastener 1240 or any suitable means for releasably securing the device in the closed position. In this embodiment, the latch is a clasp that is locks into placed by a twisting motion. In this embodiment, the hinge 1230 is a living hinge defined as a thinned piece of material between the first and second portions. In some embodiments, the living hinge can be formed integrally with the first and second portions, while in other embodiments, the living hinge can be a separate component attached between first and second portions. Device 1200 further includes a portability feature 1260, similar to those described previously.

While the exemplary embodiments have been described in some detail, by way of example and for clarity of understanding, those of skill in the art will recognize that a variety of modification, adaptations, and changes may be employed. Hence, the scope of the present invention should be limited solely by the appending claims.

In the foregoing specification, the invention is described with reference to specific embodiments thereof, but those skilled in the art will recognize that the invention is not limited thereto. Various features, embodiments and aspects of the above-described invention can be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art. It is further noted that the terms "tie," "loop," and "bands" are used interchangeably throughout.

What is claimed is:

1. A device for holding flexible hair loops or bands, the device comprising:

a first arm having a first end and a second end, wherein the first arm includes a first protrusion;

a second arm having a first end and a second end, wherein the second arm includes a second protrusion;

a hinged portion coupling the first arm and the second arm at the respective first ends of each and configured so as to move or fold the first and second arms between an open position and a closed position, wherein in the open position, the first and second protrusions are accessible from one side of the device to facilitate placement of one or more loops around the first and second protrusions, wherein in the closed position, the first and second protrusions face in opposite directions to fold or draw the one or more loops taut and a lateral guide on each of the first and second arms, on a same side as the first and second protrusions, that are configured for retaining the one or more loops in position during folding of the first and second arms from the open position to the closed position.

2. The device of claim 1, wherein each of the first and second protrusions includes an angled support member inwardly angled towards the hinged portion.

3. The device of claim 1, wherein the hinged portion comprises a barrel hinge or a butt hinge having one or more hinge pins.

4. The device of claim 1, wherein the hinged portion comprises a flush hinge configuration that allows the first and second arms to lie substantially flat with the first and second protrusions extending upwards when in the open position.

5. The device of claim 1, further comprising:

a latch to maintain the first and second arms in the closed position for storage of the one or more loops, wherein the latch is releasable to allow the device to be opened for ready removal of one or more loops when stored thereon.

6. The device of claim 1, further comprising:

a portability feature comprising a hole or loop.

7. The device of claim 1, wherein the device is formed of a substantially rigid or semi-rigid material, wherein the material is sufficiently rigid to hold the one or more loops drawn taut, at least partly.

8. The device of claim 1, wherein the device is dimensioned and configured to hold at least three flexible or elastic hair loops between the first and second protrusions and hold the at least three hair loops drawn taut, at least partly.

9. A device for holding flexible loops or bands, the device comprising:

a first portion having a first protrusion extending therefrom;

a second portion having a second protrusion extending therefrom;

wherein the first portion and second portion are attached or integrally formed;

wherein the first and second portions are configured so as to lie substantially flat on an underside thereof such that the first and second protrusions protrude from a top side thereof and are spaced apart and accessible by the user from the top side so as to receive one or more flexible loops or bands placed along a path extending around the first and second protrusions of the first and second portions so that each flexible loop or band is held taut by the first and second protrusions of the first and second portions so as to secure the one or more flexible loops or bands thereon; and a lateral guide on each of the first and second portions, on a same side as the first and second protrusions, that are configured for retaining the one or more loops in position during positioning of the one or more loops on the first and second portions so that the one or more loops are held taut by the first and second protrusions of the first and second portions.

* * * * *